US012742592B2

(12) United States Patent
Dummer et al.

(10) Patent No.: US 12,742,592 B2
(45) Date of Patent: Sep. 22, 2026

(54) CRYO-COLLECTION SYSTEMS AND RELATED METHODS AND HYPERPOLARIZER SYSTEMS

(71) Applicant: Polarean, Inc., Durham, NC (US)

(72) Inventors: Andrew K. Dummer, Chapel Hill, NC (US); Matthew Linford, Chapel Hill, NC (US)

(73) Assignee: POLAREAN, INC., Durham, NC (US)

( * ) Notice: Subject to any disclaimer, the term of this patent is extended or adjusted under 35 U.S.C. 154(b) by 302 days.

(21) Appl. No.: 18/433,770

(22) Filed: Feb. 6, 2024

(65) Prior Publication Data

US 2024/0271867 A1 Aug. 15, 2024

Related U.S. Application Data

(60) Provisional application No. 63/484,078, filed on Feb. 9, 2023.

(51) Int. Cl.
*F25J 3/06* (2006.01)

(52) U.S. Cl.
CPC ..... *F25J 3/0685* (2013.01); *F25J 2210/42* (2013.01); *F25J 2215/36* (2013.01); *F25J 2280/02* (2013.01)

(58) Field of Classification Search
CPC .. F25J 2210/42; F25J 2215/36; F25J 2280/02; F25J 3/0685; C01B 23/0036
See application file for complete search history.

(56) References Cited

U.S. PATENT DOCUMENTS

| | | | | |
|---|---|---|---|---|
| 5,488,831 | A | 2/1996 | Griswold | |
| 5,545,396 | A | 8/1996 | Albert et al. | |
| 5,612,103 | A | 3/1997 | Driehuys et al. | |
| 5,642,625 | A | 7/1997 | Cates et al. | |
| 5,809,801 | A | 9/1998 | Cates et al. | |
| 5,860,295 | A | 1/1999 | Cates et al. | |
| 6,305,190 | B1 | 10/2001 | Driehuys et al. | |
| 6,499,312 | B1 * | 12/2002 | Bergman, Jr. | F25J 3/04424 62/643 |
| 6,568,206 | B2 * | 5/2003 | Scharpf | F25J 3/0223 62/624 |
| 6,698,423 | B1 | 3/2004 | Honkonen et al. | |
| 6,735,977 | B2 | 5/2004 | Kuzma et al. | |
| 8,210,058 | B2 * | 7/2012 | Welker | G01N 1/10 73/864.62 |
| 8,713,964 | B2 * | 5/2014 | Le Bihan | F25J 3/04024 62/643 |
| 9,139,436 | B2 * | 9/2015 | Wanner | F25J 3/0285 |

(Continued)

OTHER PUBLICATIONS

International Search Report and the Written Opinion of the International Searching Authority corresponding to International Patent Application No. PCT/US2024/014568 (16 pages) (mailed Jun. 10, 2024).

(Continued)

*Primary Examiner* — Filip Zec
(74) *Attorney, Agent, or Firm* — Myers Bigel, P.A.

(57) ABSTRACT

Cryo-collection systems are provided with a fluid flow paths to a chamber enclosing at least part of an accumulator to serially provide coolant liquid and heated liquid to provide the cooling and then the heating to respectively collect/freeze, then thaw a target gas, such as collected $^{129}$Xe, in the accumulator.

33 Claims, 16 Drawing Sheets

(56) References Cited

U.S. PATENT DOCUMENTS

| | | | | |
|---|---|---|---|---|
| 10,317,135 | B2 * | 6/2019 | Briglia | F25J 3/0625 |
| 2002/0069650 | A1 | 6/2002 | Hasson et al. | |
| 2002/0168419 | A1 | 11/2002 | Bolam et al. | |
| 2003/0046941 | A1 | 3/2003 | Pant et al. | |
| 2004/0211191 | A1 | 10/2004 | Driehuys et al. | |
| 2006/0090477 | A1 | 5/2006 | Rolff | |
| 2011/0152849 | A1 | 6/2011 | Baust et al. | |
| 2011/0283737 | A1 * | 11/2011 | Alvord | B01D 53/0438 62/617 |
| 2012/0031144 | A1 | 2/2012 | Northrop et al. | |
| 2012/0070364 | A1 * | 3/2012 | Malhotra | F25J 3/0276 422/148 |
| 2014/0283550 | A1 | 9/2014 | Bonne et al. | |
| 2015/0033765 | A1 * | 2/2015 | Blalock | F17C 7/04 62/47.1 |
| 2015/0211682 | A1 | 7/2015 | Cipriani et al. | |
| 2019/0346203 | A1 * | 11/2019 | Chen | F25J 1/0072 |
| 2021/0080175 | A1 * | 3/2021 | Hernandez | F25J 3/0257 |
| 2021/0116072 | A1 | 4/2021 | Obrad et al. | |
| 2022/0268517 | A1 * | 8/2022 | Ladd | F25J 1/0265 |
| 2024/0271866 | A1 | 8/2024 | Dummer | |

OTHER PUBLICATIONS

Birchall , et al., "Helium-Rich Mixtures for Improved Batch-Mode Clinical-Scale Spin-Exchange Optical Pumping of Xenon-129", Journal of Magnetic Resonance, 315:106739 (2020).

Khan , et al., "Enabling Clinical Technologies for Hyperpolarized Xenon-129 MRI and Spectroscopy", Angewandte Chemie, 60(41):22126-22147 (2021).

Patel , et al., "Design and Optimization of Cryogenic Storage Vessel", IJEDR, 3(1):208-216 (2014).

Invitation to Pay Additional Fees and, Where Applicable, Protest Fee corresponding to International Patent Application No. PCT/US2024/014568 (2 pages) (mailed Apr. 15, 2024).

Sunpower, Inc. "CryoTel® GT Installation & Operation Manual" Rev. 8 (106 pages) (2016).

* cited by examiner

CRYO-COLLECTION SYSTEMS AND RELATED METHODS AND HYPERPOLARIZER SYSTEMS

RELATED APPLICATIONS

This patent application claims priority to and the benefit of U.S. Provisional Application Ser. No. 63/484,078, filed Feb. 9, 2023, the contents of which are hereby incorporated by reference as if recited in full herein.

GOVERNMENT RIGHTS

This invention was made with Government support under US National Institutes of Health National Heart, Lung and Blood Institute Phase II Small Business Innovation Research Program Grant, Grant number 2R44HL123299-04. The United States Government has certain rights in the invention.

FIELD OF THE INVENTION

The present invention relates to the cryogenic collection of gas and is particularly suitable for collecting a hyperpolarized noble gas for use in magnetic resonance imaging ("MRI") applications.

BACKGROUND OF THE INVENTION

Conventionally, MRI has been used to produce images by exciting the nuclei of hydrogen atoms (present in water molecules) in the human body. MRI imaging with polarized noble gases can produce improved images of certain areas and regions of the body. Polarized Helium-3 ("$^{3}$He") and Xenon-129 ("$^{129}$Xe") have been found to be particularly suited for this purpose.

Hyperpolarizers are used to produce and accumulate polarized noble gases. Hyperpolarizers artificially enhance the polarization of certain noble gas nuclei (such as $^{129}$Xe or $^{3}$He) over the natural or equilibrium levels, i.e., the Boltzmann polarization. Such an increase is desirable because it enhances and increases the Magnetic Resonance Imaging ("MRI") signal intensity, allowing physicians to obtain better images of the substance in the body. See U.S. Pat. No. 5,642,625 to Cates et al. and U.S. Pat. No. 5,545,396 to Albert et al., the contents of which are hereby incorporated herein by reference as if recited in full herein.

In order to produce the hyperpolarized gas, the noble gas is typically blended with optically pumped alkali metal vapors such as rubidium ("Rb"). These optically pumped metal vapors collide with the nuclei of the noble gas and hyperpolarize the noble gas through a phenomenon known as "spin-exchange." The "optical pumping" of the alkali metal vapor is produced by irradiating the alkali-metal vapor with circularly polarized light at the wavelength of the first principal resonance for the alkali metal (e.g., 795 nm for Rb). Generally stated, the ground state atoms become excited, then subsequently decay back to the ground state. Under a modest magnetic field (10 Gauss), the cycling of atoms between the ground and excited states can yield nearly 100% polarization of the atoms in a few microseconds. This polarization is generally carried by the lone valence electron characteristics of the alkali metal. In the presence of non-zero nuclear spin noble gases, the alkali-metal vapor atoms can collide with the noble gas atoms in a manner in which the polarization of the valence electrons is transferred to the noble-gas nuclei through a mutual spin flip "spin-exchange."

Conventionally, lasers have been used to optically pump the alkali metals. Various lasers emit light signals over various wavelength bands. In order to improve the optical pumping process for certain types of lasers (particularly those with broader bandwidth emissions), the absorption or resonance line width of the alkali metal can be made broader to more closely correspond with the particular laser emission bandwidth of the selected laser. This broadening can be achieved by pressure broadening, i.e., by using a buffer gas in the optical pumping chamber. Collisions of the alkali metal vapor with a buffer gas will lead to a broadening of the alkali's absorption bandwidth.

In traditional spin exchange optical pumping (SEOP) constant flow systems, a helium-nitrogen-($^{129}$)xenon gas mixture flows through the optical cell where the SEOP process occurs. Subsequently, the hyperpolarized $^{129}$Xe is separated and collected from this gas mixture. Traditionally, this is accomplished by flowing the gas through a glass condenser submerged in liquid nitrogen. The $^{129}$Xe freezes to the interior of the condenser while the remainder of the gas mixture vents from the system. Following the collection, the gas stream is stopped, the remainder of the gas in the condenser is evacuated, the dewar containing the liquid nitrogen is removed, and a vessel containing water is brought up and the condenser is submerged in the vessel with the water, rapidly warming the $^{129}$Xe back to a gaseous state which is flowably collected in a collection container, such as a TEDLAR bag for administration to patients. For examples of prior cryogenic accumulators, see, e.g., U.S. Pat. Nos. 5,809,801; 6,305,190 and 6,735,977, the contents of which are hereby incorporated by reference as if recited in full herein.

However, there is a need for alternate cryogenic collectors/accumulators that do not require users to move components to facilitate clinical use and reduce manual actions of different users.

SUMMARY

Embodiments of the present invention provide a cryo-collection system that has a first fluid flow path and a second fluid flow path that are both in fluid communication with a chamber of a dewar that holds at least a portion of an accumulator/condenser. The chamber serially holds, then drains, liquid from the first and second flow paths, respectively. The liquids serially freeze $^{129}$Xe, then thaw $^{129}$Xe in the accumulator. The accumulator is statically mounted to remain in a fixed position in the dewar during the freeze and thaw actions.

Embodiments of the present invention provide a cryo-collection system that electronically, serially directs the coolant liquid to flow into a chamber of the dewar about the accumulator to cool to accumulate/freeze the $^{129}$Xe then drain the coolant liquid and direct liquid water to flow into the chamber about the accumulator to heat to thaw the accumulated $^{129}$Xe.

Embodiments of the present invention provide a self-contained cryo-collection system with first and second fluid flow paths that controllably, serially, introduce different liquids to cool then heat the accumulator a chamber in a dewar (vacuum insulated vessel).

Embodiments of the present invention are directed to a cryo-collection system that includes an accumulator having a gas flow path configured for receiving and condensing a target gas from a gas mixture and a dewar that encloses at least part of the accumulator providing the gas flow path. The dewar has a chamber that is configured to hold liquid that is in thermal communication with the accumulator and that is in fluid isolation from the gas flow path. The dewar also has a liquid drain port in fluid communication with the chamber. The system also includes a coolant liquid source configured to supply a coolant liquid to the chamber. The coolant liquid freezes target gas (such as, for example, $^{129}$Xe) from the gas mixture to thereby collect the target gas in the gas flow path of the accumulator. The system also includes a heated liquid source configured to supply heated liquid to the chamber. The heated liquid has a temperature sufficient to thaw the frozen target gas. The system is configured so that the coolant liquid and the heated liquid both serially drain from the chamber through the drain port.

The system can have a drain path that has a first drain valve downstream of the drain port of the chamber.

The drain path can further include a second drain valve downstream of the drain port. The second drain valve can be spaced apart from the first drain valve.

The system can have a controller in communication with the first drain valve and the second drain valve and that can be configured to controllably open and close the first and second drain valves so that only the first drain valve is open when the coolant liquid is drained from the chamber and only the second drain valve is open when the heated liquid is drained from the chamber.

The chamber can be configured to hold a volume of liquid in a range of 0.5 liters to 2 liters.

The system can also have an outlet heater in the drain path upstream of the first drain valve, between the first drain valve and the drain port.

The system can have an outlet heater in the drain path, upstream of the second drain valve, between the second drain valve and the drain port.

The drain port can reside at a bottom portion of the dewar.

The coolant liquid source can have/provide liquid nitrogen.

The heated liquid source can be provided by a tank of heated water.

The outlet heater can be coupled to an external surface of a metal tube extending through a bottom portion of the dewar below the drain port. The metal tube can provide part of the drain path.

The system can have a drain path that includes a metal tube extending outward from a bottom portion of the dewar in fluid communication with the drain port.

A first drain valve of the system can be coupled to a first external end of the metal tube and a second drain valve can be coupled to a second external end of the metal tube. The first external end of the metal tube can be diametrically opposed to the second external end of the metal tube about a body of the dewar.

The dewar can have at least one fill port in fluid communication with the coolant liquid source and/or the heated liquid source.

The dewar can have a first fill port in fluid communication with the coolant liquid source and a second fill port in fluid communication with the heated liquid source.

The target gas can be $^{129}$Xe and the gas mixture can be a hyperpolarized gas mixture with the $^{129}$Xe. The accumulator can have an entry conduit in communication with a valve and can be configured to receive the hyperpolarized noble gas mixture during collection of the $^{129}$Xe. The accumulator can have an exit conduit that flowably transfers thawed $^{129}$Xe out to a collection vessel after thaw.

The gas flow path of the accumulator can have a tube segment provided in a curvilinear shape.

The system can further include first and second drain valves that are spaced apart and coupled to a drain path. The drain path is in fluid communication with the drain port. The system can also include first and second outlet heaters coupled to the drain path, a temperature probe in the chamber, and a controller.

The controller can be configured to: direct a valve of the coolant liquid source to open to flow the coolant liquid to the chamber; then close the valve to stop the flow of coolant liquid into the chamber; monitor temperature in the chamber using the temperature probe and open the valve to flow additional coolant liquid into the chamber if the temperature in the chamber rises above a defined temperature; then when collection is complete, direct the first drain valve to open while the second drain valve remains closed to drain the coolant liquid from the drain port; then close the first drain valve; and then direct the heated liquid source to flow the heated liquid to the chamber while the first drain valve and the second drain valve are closed.

In operation, liquid can be held in the chamber to a fill level whereby a sub-segment of the accumulator is surrounded by the liquid. The dewar can have a drain path below the drain port, and the liquid can be held in the drain path when the liquid is in a fill level in the chamber during freeze and thaw actions provided by the coolant liquid and the heated liquid, respectively.

Embodiments of the invention can be arranged as a flow-through spin exchange optical pumping (SEOP) hyperpolarized gas production system for producing hyperpolarized gas. The SEOP system can have: a pressurized gas mixture providing the gas mixture with the target gas; a flow-through optical pumping cell in fluid communication with the pressurized gas mixture configured to provide a hyperpolarized gas mixture; and the cryo-collection system with the dewar and chamber downstream of and in fluid communication with the flow-through optical pumping cell.

The flow-through SEOP gas production system can further include a flexible patient dose delivery bag downstream of the cryo-collection system and an inhalable bolus of hyperpolarized $^{129}$Xe collected, then thawed by the cryo-collection system.

The cryo-collection system can be provided as a first cryo-collection system. The flow-through SEOP gas production system can also have a second cryo-collection system downstream of and in fluid communication with the optical pumping cell. The second cryo-collection system can have a second dewar with the chamber and drain port, wherein the first and second cryo-collection systems are serially and alternately operable to collect frozen $^{129}$Xe from the hyperpolarized gas mixture from the optical pumping cell.

Other aspects of the present invention are directed to methods of collecting hyperpolarized $^{129}$Xe, that includes: providing a cryo-collection system comprising a dewar with an internal liquid chamber and an accumulator; flowing liquid nitrogen into the chamber to cool the accumulator to a sufficient temperature to freeze and collect hyperpolarized $^{129}$Xe from a hyperpolarized noble gas mixture; then draining the liquid nitrogen from the chamber; then flowing heated water into the chamber to heat the collected hyperpolarized $^{129}$Xe to a sufficient temperature to thaw the collected hyperpolarized $^{129}$Xe; and then flowing the thawed hyperpolarized $^{129}$Xe out of the accumulator into an enclosed flow path.

The method can include, after the flowing out of the accumulator, filling a container with at least one bolus amount of hyperpolarized $^{129}$Xe gas.

The method can include dispensing a bolus amount of hyperpolarized $^{129}$Xe gas to a patient for inhalation to thereby allow for gas exchange and/or ventilation evaluation of a lung or lungs of the patient.

The method can include draining the water from the chamber, then flowing another quantity of liquid nitrogen into the chamber to cool the accumulator to freeze and collect another amount of hyperpolarized $^{129}$Xe from a hyperpolarized noble gas mixture.

The draining the liquid nitrogen and the draining the water can both be carried out using a common drain located at a bottom of the dewar.

The providing the cryo-collection system can be carried out by providing first and second cryo-collection systems, each comprising a respective dewar with internal liquid chamber, accumulator, and liquid nitrogen and water flow paths. The method can further include directing either the first or the second cryo-collection system to collect hyperpolarized $^{129}$Xe from the hyperpolarized noble gas mixture to thereby alternate between the use of the first and second cryo-collection systems to reduce or eliminate deadtime between successive collections of hyperpolarized $^{129}$Xe from the hyperpolarized noble gas mixture.

Yet additional embodiments are directed to a dewar for cryo-collection. The dewar includes: a dewar body enclosing a chamber; and a drain port in the dewar body in fluid communication with the chamber.

The dewar can include at least one liquid fill port in fluid communication with the chamber.

The dewar can further include a drain path comprising a metal tube extending outward from a bottom portion of the dewar in fluid communication with the drain port.

A first drain valve can be coupled to a first external end of the metal tube and a second drain valve is coupled to a second external end of the metal tube. The first external end of the metal tube can be diametrically opposed to the second external end of the metal tube about a body of the dewar.

The dewar can have an outlet heater coupled to an external surface of a metal tube extending through a bottom portion of the dewar below the drain port and that provides part of drain path.

As will be appreciated by those of skill in the art in light of the above discussion, the present invention may be embodied as methods, systems and/or computer program products or combinations of same. In addition, it is noted that aspects of the invention described with respect to one embodiment, may be incorporated in a different embodiment although not specifically described relative thereto. That is, all embodiments and/or features of any embodiment can be combined in any way and/or combination for any number of desired activities and/or any degree of activity performance complexity or variability. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

The foregoing and other objects and aspects of the present invention are explained in detail herein.

BRIEF DESCRIPTION OF THE DRAWINGS

Other features of the present invention will be more readily understood from the following detailed description of exemplary embodiments thereof when read in conjunction with the accompanying drawings.

DETAILED DESCRIPTION

Figure 1A:
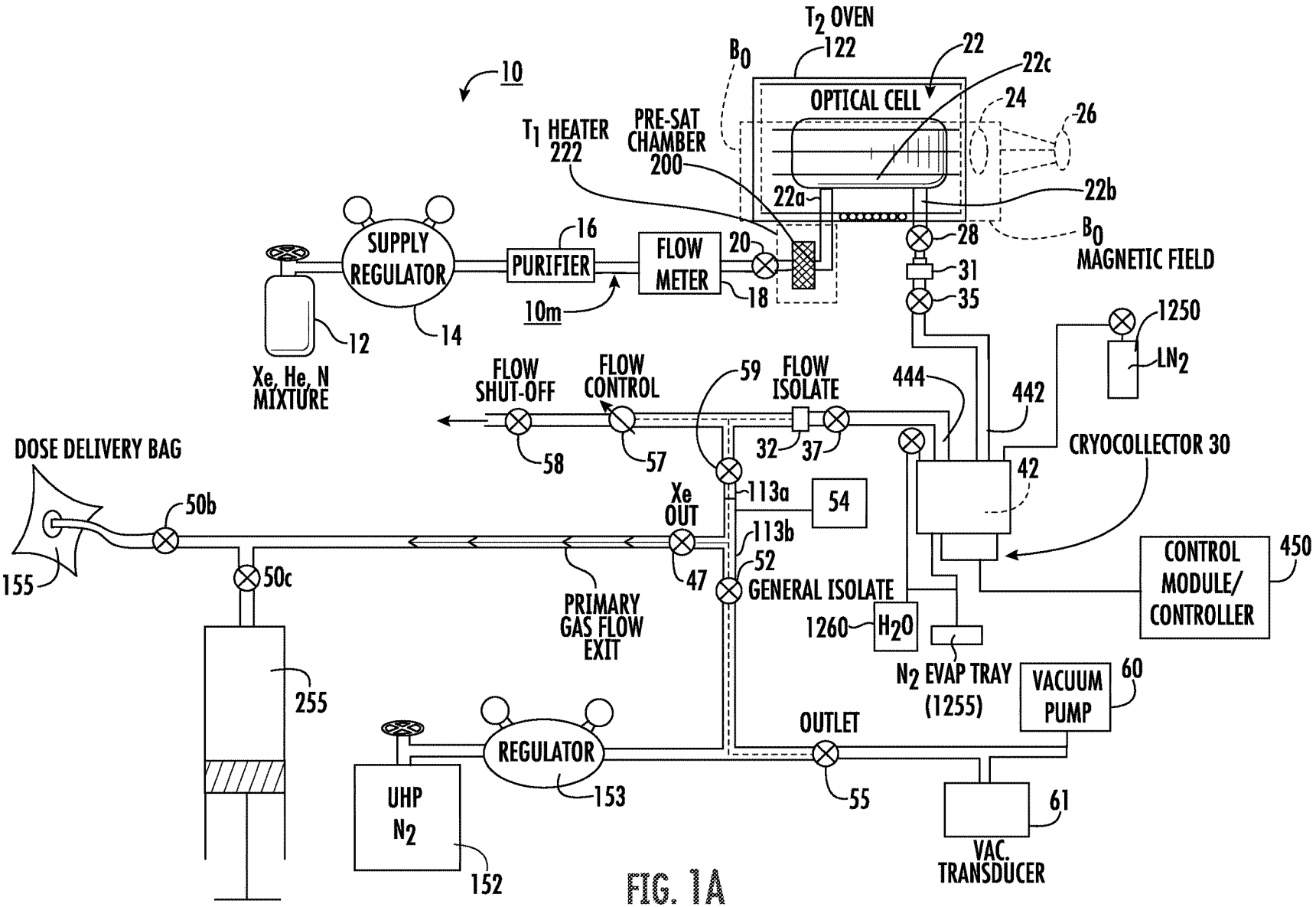
FIG. 1A is a schematic illustration of a hyperpolarizer incorporating a cryo-collection system according to embodiments of the present invention.

The present invention will now be described more fully hereinafter with reference to the accompanying figures, in which preferred embodiments of the invention are shown.

This invention may, however, be embodied in many different forms and should not be construed as limited to the embodiments set forth herein.

Like numbers refer to like elements throughout. In the figures, layers, regions and/or components may be exaggerated for clarity. The word "Figure" is used interchangeably with the abbreviated forms "FIG." and "Fig." in the text and/or drawings. Broken lines illustrate optional features or operations unless specified otherwise. In the description of the present invention that follows, certain terms are employed to refer to the positional relationship of certain structures relative to other structures.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

It will also be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Spatially relative terms, such as "under", "below", "lower", "over", "upper" and the like, may be used herein for case of description to describe one element or feature's relationship to another element(s) or feature(s) as illustrated in the figures. It will be understood that the spatially relative terms are intended to encompass different orientations of the data or information in use or operation in addition to the orientation depicted in the figures. For example, if data in a window view of the system in the figures is inverted, elements described as "under" or "beneath" other elements or features would then be oriented "over" the other elements or features. Thus, the exemplary term "under" can encompass both an orientation of over and under. The display view may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

As used herein, the term "forward" and derivatives thereof refer to the general direction a noble gas mixture travels as it moves through the hyperpolarizer system; this term is meant to be synonymous with the term "downstream" which is often used in manufacturing environments to indicate that certain material being acted upon is farther along in the manufacturing process than other material. Conversely, the terms "rearward" and "upstream" and derivatives thereof refer to the directions opposite, respectively, the forward and downstream directions.

Also, as described herein, polarized gases can be collected, frozen, then thawed, and used in MRI applications. For ease of description, the term "frozen polarized gas" means that the polarized gas has been frozen into a solid state. The term "liquid polarized gas" means that the polarized gas has been or is being liquefied into a liquid state. Thus, although each term includes the word "gas", this word is used to name and descriptively track the gas which is produced via a hyperpolarizer to obtain a polarized "gas" product. Therefore, as used herein, the term gas has been used in certain places to descriptively indicate a hyperpolarized noble gas product and may be used with modifiers such as solid, frozen, and liquid to describe the state or phase of that product.

In some embodiments, the polarized $^{129}$Xe gas can be produced and formulated to be suitable for internal pharmaceutical human or animal medical purposes.

The term "about" means within plus or minus 10% of a recited number.

The term "polarization friendly" means that the device is configured and formed of materials and/or chemicals that do not induce or cause more than di minimis decay (e.g., less than about 2%) of the polarization of the polarized noble gas, e.g., $^{129}$Xe.

The term "compact" with respect to optical pumping cells, refers to optical pumping cells that are between about 50 cubic centimeters ("ccs") to about 1000 ccs, typically between about 100 ccs and 500 ccs, in volumetric capacity.

The term "high volume" means that the polarizer is a continuous flow polarizer (or at least substantially continuous), once activated for production for a given supply of gas mixture to produce at least between about 1.5 ccs to about 500 cc's of polarized noble gas per minute, and/or between about 1000 cc's to about 10,000 cc's, or even more, per hour. The terms "polarizer" and "hyperpolarizer" are used interchangeably herein.

Figure 1B:
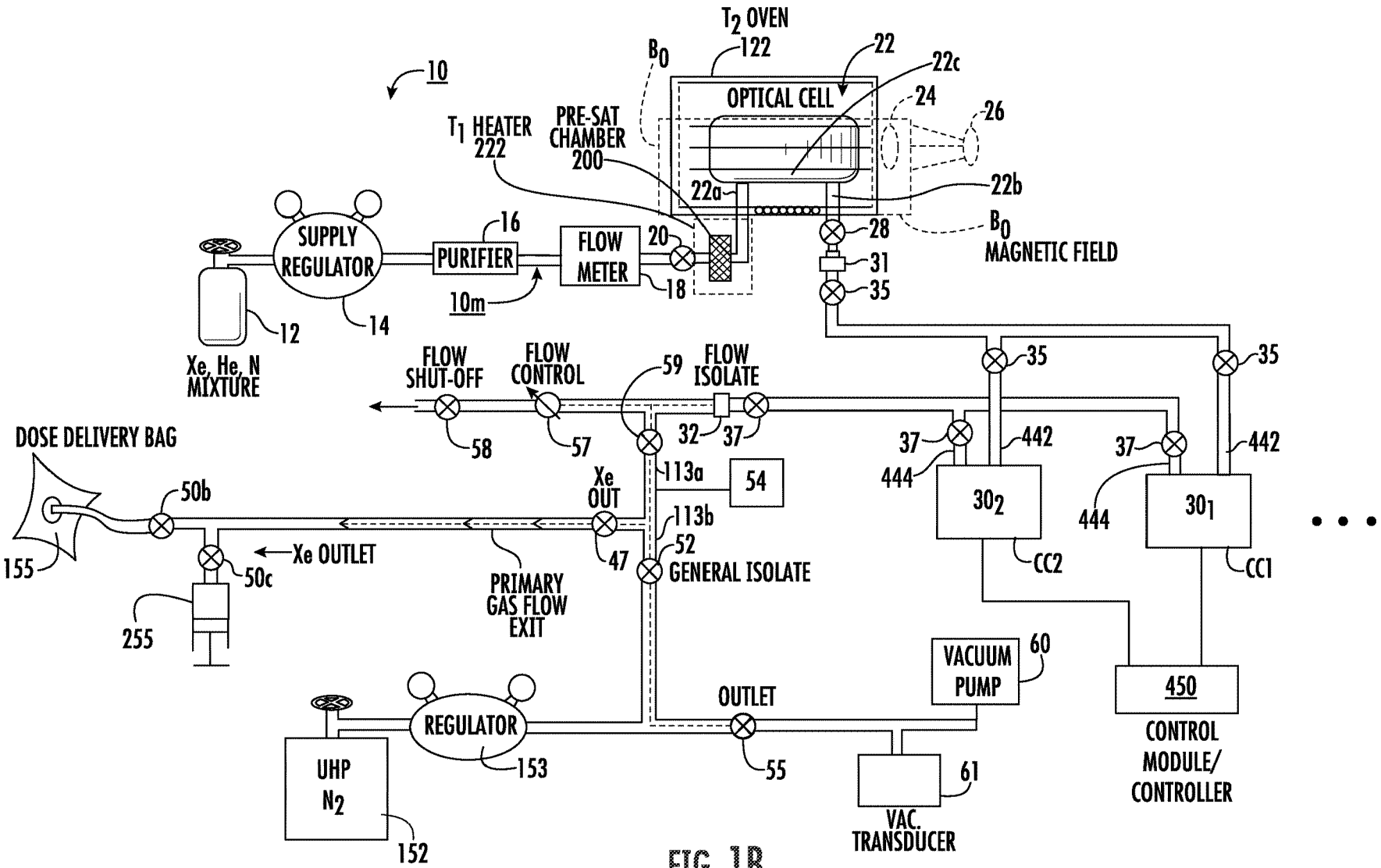
FIG. 1B is a schematic illustration of a hyperpolarizer incorporating multiple cryo-collection systems according to embodiments of the present invention.
Figure 2:
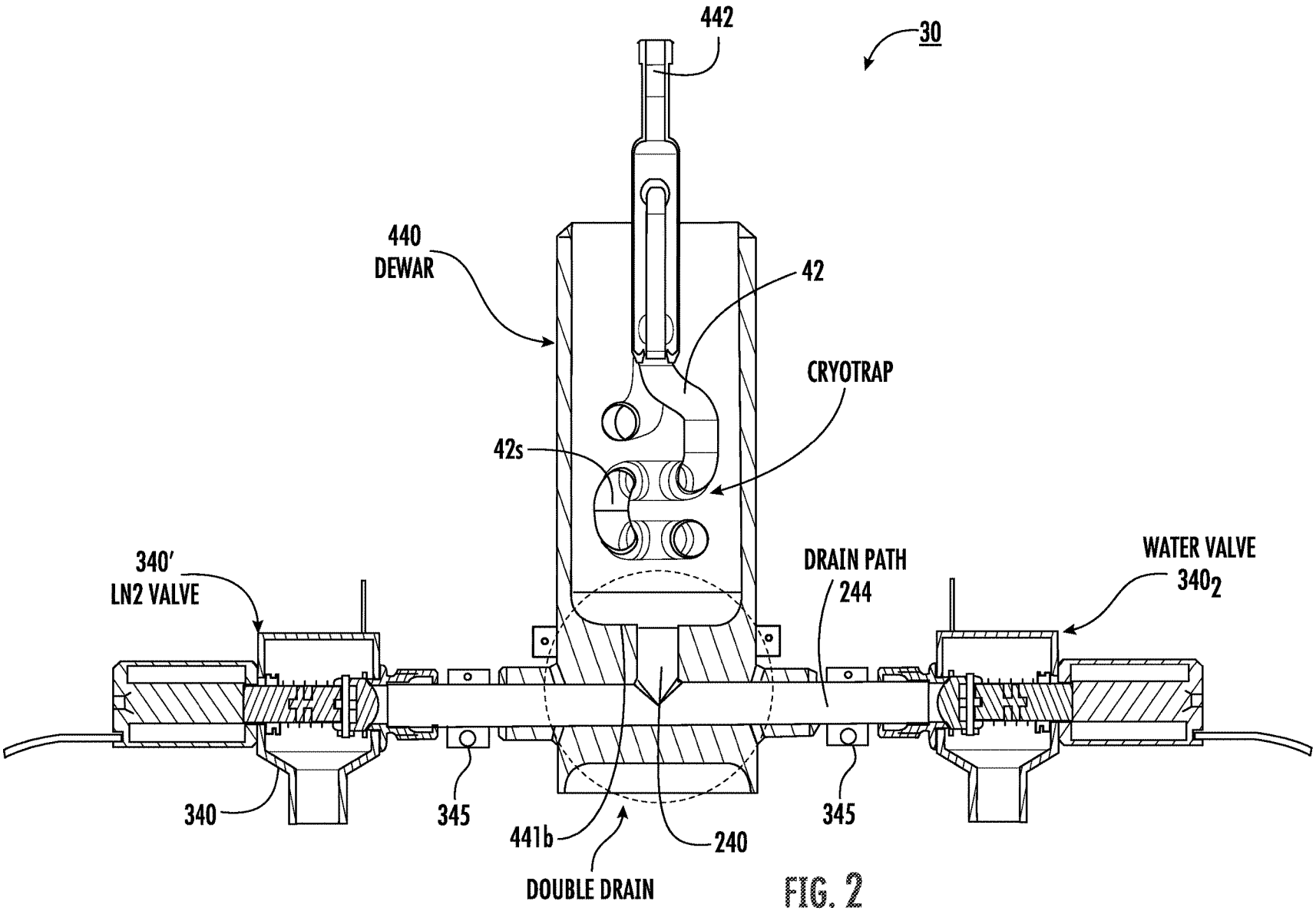
FIG. 2 is a partial section view of a portion of a cryo-collection system according to embodiments of the present invention.

With reference to FIG. 1A, an example hyperpolarizer 10 is shown. The hyperpolarizer 10 includes an optical pumping cell 22 upstream of a cryo-collection system 30. A control module 450 comprising at least one processor (and which can also be referred to interchangeably as a controller) can be coupled to components of the cryo-collection system 30 to electronically control operation thereof. FIG. 1B illustrates that the hyperpolarizer 10 can comprise a plurality of cryo-collection systems 30, shown as first and second systems $\mathbf{30}_1$, $\mathbf{30}_2$, respectively. It is noted that the hyperpolarizer 10 can comprise more than two such cryo-collection systems 30. Additional components of the hyperpolarizer 10 shown in FIGS. 1A and 1B will be discussed below. Commercial hyperpolarizers comprising gas handling manifolds, a xenon polarizer and supporting devices are available from Polarean, Inc., Durham, North Carolina.

Turning now to FIGS. 2-7, as shown, the cryo-collection system 30 comprises an accumulator 42 that condenses and accumulates frozen hyperpolarized $^{129}$Xe from the hyperpolarized noble gas mixture exiting the optical pumping cell 22 (FIGS. 1A/1B) and entering the cryo-collection system 30 through an inlet conduit 442.

The cryo-collection system 30 is shown with a dewar 440, e.g., a vacuum insulating vessel, that comprises a chamber 441 that encloses at least part of the accumulator 42. The chamber 441 has a drain port 240 that merges into a drain path 244 for draining liquid 445 exiting the chamber 441. The accumulator 42 can have a (sub) segment 42*s* that is configured to reside below a liquid fill line or level 443 of the chamber 441 during cooling for condensing and collecting, thereby accumulating, frozen $^{129}$Xe from a hyperpolarized noble gas mixture, then heating the collected $^{129}$Xe to dispense to a collection container 155.

Although shown as a single drain port 240 residing at a bottom portion 441*b* of the chamber 441, more than one drain port 240 may be used and the one or more drain ports 240 may reside at different positions of the chamber 441 and/or dewar 440.

The accumulator 42 of the cryo-collection system 30 also comprises an inlet conduit 442 and an outlet conduit 444 (FIGS. 1A/1B, 4B). The inlet conduit 442 is coupled to the gas flow path from the optical pumping cell 22. The outlet conduit 444 directs thawed hyperpolarized $^{129}$Xe to the outlet flow path for dispensing to the collection vessel 155. Part of the inlet conduit 442 and at least part of the outlet conduit 444 can reside inside the dewar 440.

Optionally, the accumulator 42 can also have a smaller conduit 1444 (FIGS. 3, 4A) that is in thermal communication with the outlet conduit 444 and that may be used to provide warm air or other gas to heat the outlet conduit 444. The smaller diameter conduit 1444 can connect to a heating jacket used to warm the outgoing gas to prevent it from chilling the connection point, potentially causing leaks. However, other configurations may be used such as, for example, arranging the incoming hyperpolarized noble gas mixture to warm the outgoing $^{129}$Xe gas to eliminate the warming jacket.

The drain path 244 can comprise at least one drain valve 340 downstream of the drain port 240, shown in FIGS. 2-7 as first and second spaced apart and separate drain valves $\mathbf{340}_1$, $\mathbf{340}_2$, each configured to reside downstream of the drain port 240 to open and close, respectively. In the open position of the first drain valve $\mathbf{340}_1$, the coolant liquid 445*c* is directed from the chamber 441 out the drain port 240 to a drain path 244 that merges into a further portion of the drain and/or discharge path 245*c* downstream of the first drain valve $\mathbf{340}_1$ then to a discharge vessel 1255 such as an evaporation tray. In the closed position, the drain path 244 between the first drain valve $\mathbf{340}_1$ and the drain port 240 typically comprises liquid 445.

In the open position of the second drain valve $\mathbf{340}_2$, the heated liquid 445*h* is directed from the chamber 441 out the drain port 240 to a drain path 244 to a discharge path 245*h* downstream of the second drain valve $\mathbf{340}_2$ then to a discharge vessel, which can be a heated liquid source 1260 providing the heated liquid 445*h*, where recirculating heated liquid configurations are used. However, recirculating heated liquid systems are optional, and a dedicated discharge vessel (1270, FIG. 8A) may be used or even a discharge conduit or a pipe that can be coupled to a building/facility drain may be used. In the closed position, the drain path 244 between the second drain valve $\mathbf{340}_2$ and the drain port 240 typically comprises liquid 445.

At least one liquid entry or fill port 1245 can be in fluid communication with the chamber 441 of the dewar 440. The (at least one) entry or fill port 1245 can be provided as first and second liquid entry or fill ports $\mathbf{1245}_1$, $\mathbf{1245}_2$, each above the drain port 240 and respectively coupled to a fluid delivery conduit 1244, one in fluid communication with, connected to, a coolant liquid source 1250 for providing coolant liquid 445*c*, and one in fluid communication with, connected to a heated liquid source 1260, for providing heated liquid. One or more valves, such as valves 1244*v*, can be used to control flow of the appropriate liquid 445 into the dewar chamber 441 at the appropriate times.

Figure 8A:
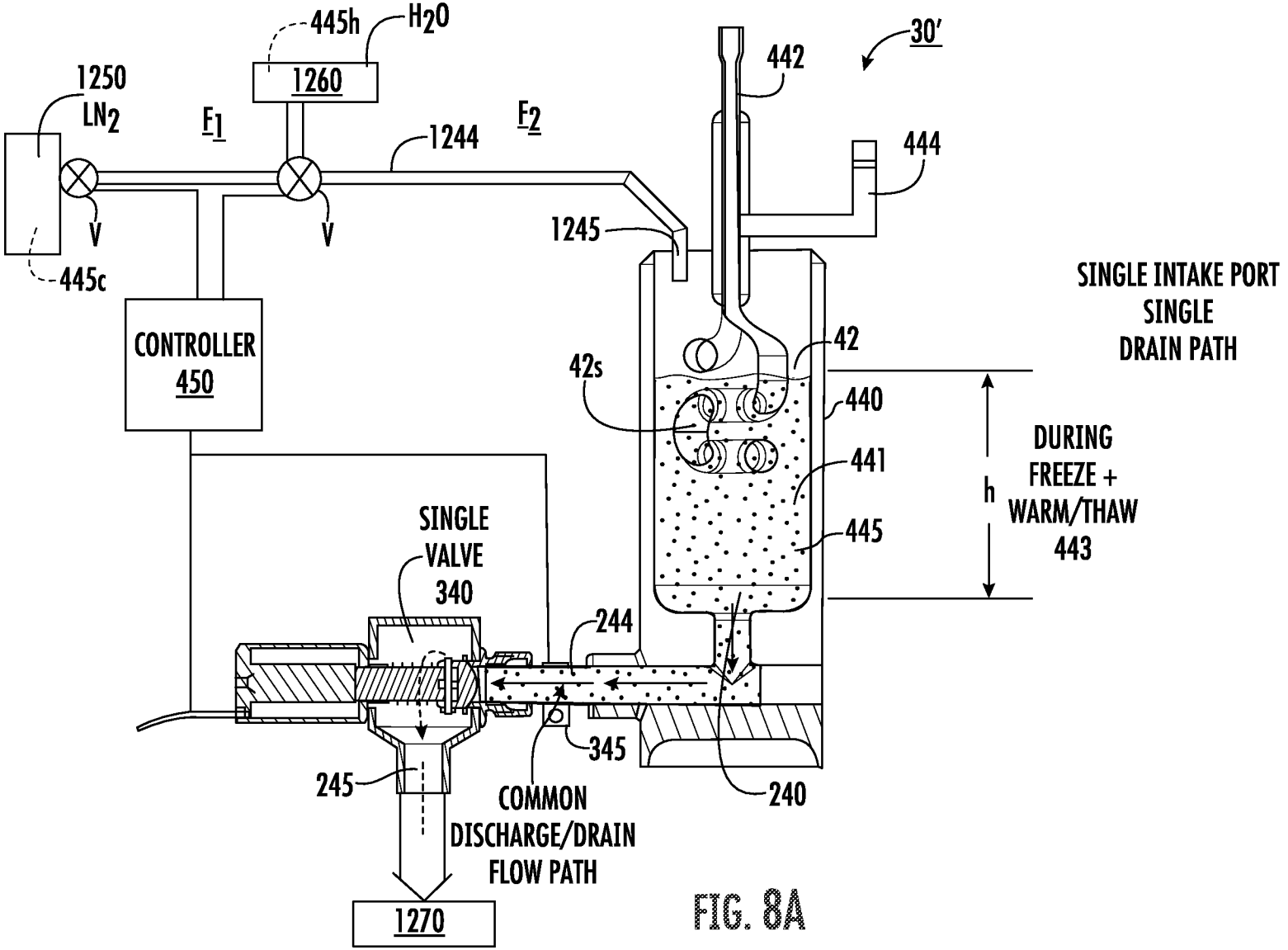
FIG. 8A is a schematic illustration of another example embodiment of a portion of a cryo-collection system providing shared fluid flow paths an accumulator according to embodiments of the present invention.

FIG. 8A illustrates another example embodiment of the cryo-collection system 30'. In this embodiment, a single liquid fill port 1245 is used to provide the heated liquid 445*h* and the coolant liquid 445*c*. FIG. 8A also shows that the drain path 244 can be common and use a single valve 340 for closing the drain path 244 for both of the liquids 445, the heated liquid 445*h* and the coolant liquid 445*c*. Any common lines for the coolant liquid and the heated liquid may need to be heated to remove the coolant liquid before introducing the heated liquid to prevent icing.

Figure 8B:
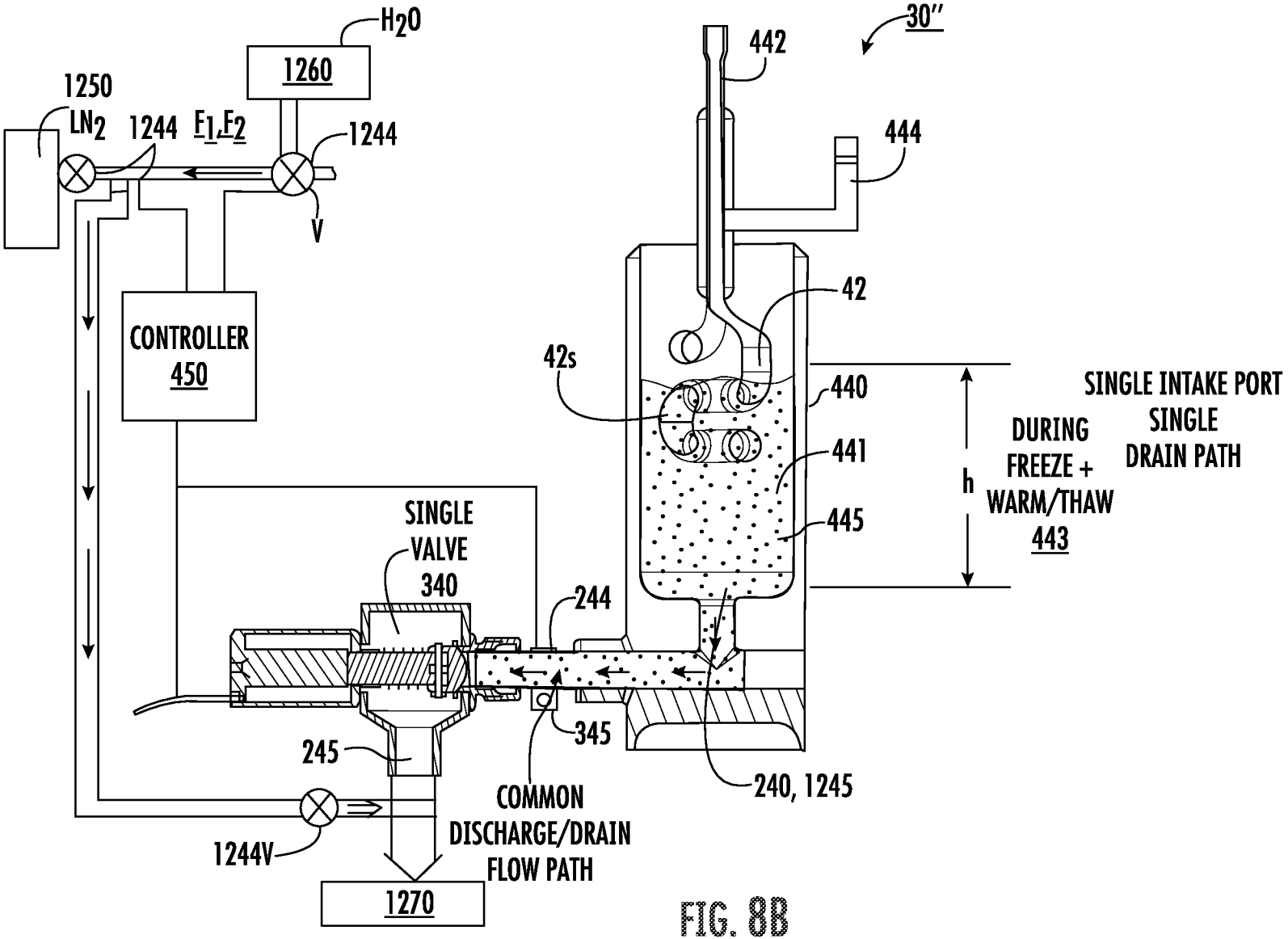
FIG. 8B is a schematic illustration of another example embodiment of a portion of a cryo-collection system providing shared fluid flow paths an accumulator according to embodiments of the present invention.

FIG. 8B illustrates yet another example embodiment of the cryo-collection system 30". In this embodiment, the drain port 240 serves as the liquid fill port 1245 for both of the heated liquid 445*h* and the coolant liquid 445*c*.

Referring again to FIGS. 2-7, the heated liquid source 1260 can be provided as a tank of heated liquid that is in fluid communication with the drain port 240 and can be in communication with a pump 1266 (FIG. 6B) configured to pump the heated liquid to the chamber 441. A discharge flow path 245*h* for the heated liquid 445*h* can be configured to return the drained heated liquid back to the tank 1260 and define a recirculating heated liquid system. The heated liquid 445*h* can be any suitable liquid, typically comprising or being water. The heated liquid is provided to the chamber 441 at a temperature sufficient to thaw collected frozen $^{129}$Xe in the accumulator 42. The heated liquid 445*h* can be heated in the heated liquid source 1260 and provided to the chamber 441 at a temperature in a range of 60-100 degrees C., such as about 80 deg. C., measured at the heated liquid source 1260, e.g., tank.

The heated liquid 445*h* can be provided to the chamber 441 at any suitable flow rate to fill the chamber 441 to a desired fill level 443. In some embodiments, the heated liquid 445*h* is delivered to the chamber 441 to a desired fill volume and held for a "soak" time to carry out the thaw cycle. Example heated liquid flow rates are in a range of 1-20 liters/min such as about 12 liters/min.

In other embodiments, the heated liquid 445*h* can be continuously or intermittently supplied to the chamber 441 during a respective thaw cycle. For example, the heated liquid 445*h* can be circulated in a recirculating fluid flow path F2 through the second drain valve $\mathbf{340}_2$ (which can be in a full or partial open position) to the heated liquid source 1260 then to the chamber 441.

The coolant liquid source 1250 can be a pressurized tank/cylinder 1250*t* of liquid nitrogen (LN2). The coolant liquid 445*c* is introduced to the dewar chamber 441 via a fill conduit 1244 to the fill port 1245 by opening a valve V to the pressurized supply tank 1250*t*.

The cryo-collection system 30 can also comprise at least one outlet heater 345 configured to prevent liquid (e.g., water) freezing in the drain path 244 coupled to the drain port 240. As shown, first and second outlet heaters 345 are used and each can be turned on when heated liquid 445*h* is introduced to the dewar chamber 441 and each can remain on during the soak time. The outlet heaters 345 can be electrically connected together in parallel and are not required to be temperature controlled. The outlet heaters 345 can inhibit ice build-up over successive runs that may otherwise clog the drain path 244. Example outlet heaters 345 can provide 100 watts of heat. An example suitable cartridge heater is available from McMaster-Carr under Part Number 35025k111, but other heater types may be used.

A temperature probe 1210 (FIG. 5A) can be positioned in the dewar chamber 441 and can be in communication with the controller 450 and used to determine when the chamber 441 is sufficiently filled with coolant liquid, e.g., LN2, which can take a few minutes, such as 1-5 minutes, typically about 2 minutes. During the freeze period for collection/accumulation of the $^{129}$Xe, it may be desirable to periodically add additional coolant liquid (e.g., LN2) to replace what is lost to evaporation. When to add more coolant liquid 445*c* can also be determined by using temperature measurements from the temperature probe 1210. When the liquid coolant 445*c* is LN2, it can be provided at its boiling point of about 77 degrees K. The flow rate depends on the tank pressure which varies but is typically less than the flow rate of the heated liquid. The coolant liquid 445*c* may be provided with a flow rate in a range of 0.1 liters/min to about 1 liter/min, such as about 0.5 liters/min.

The accumulator 42 defines a hyperpolarized noble gas mixture flow path 141*p* and a (sub) segment 42*s* of the accumulator 42 is immersed in/surrounded by the liquid 445 in the chamber 441 during respective freeze/collection and heat/thaw processes. That is, the coolant liquid 445*c* and the heated liquid 445*h* are each, serially, successively, filled to a common or different desired fill height or level 443 in the chamber 441 during respective freeze and thaw operations. The heated liquid 445*h* can remain in the chamber 441 after fill for a "soak period" for a desired time such as 1-5 minutes to carry out a respective thaw. Thus, continuous circulation of heated liquid to the chamber 441 is not required. Even though the heated liquid 445*h* will naturally cool over the time in the chamber 441, the thaw of the $^{129}$Xe will initiate and continue based on the initial exposure to the heated liquid. The coolant liquid 445*c* may be topped off/replenished in the chamber 441 during a respective collection action depending on a collection amount, evaporation and/or length of a collection period.

Figure 3:
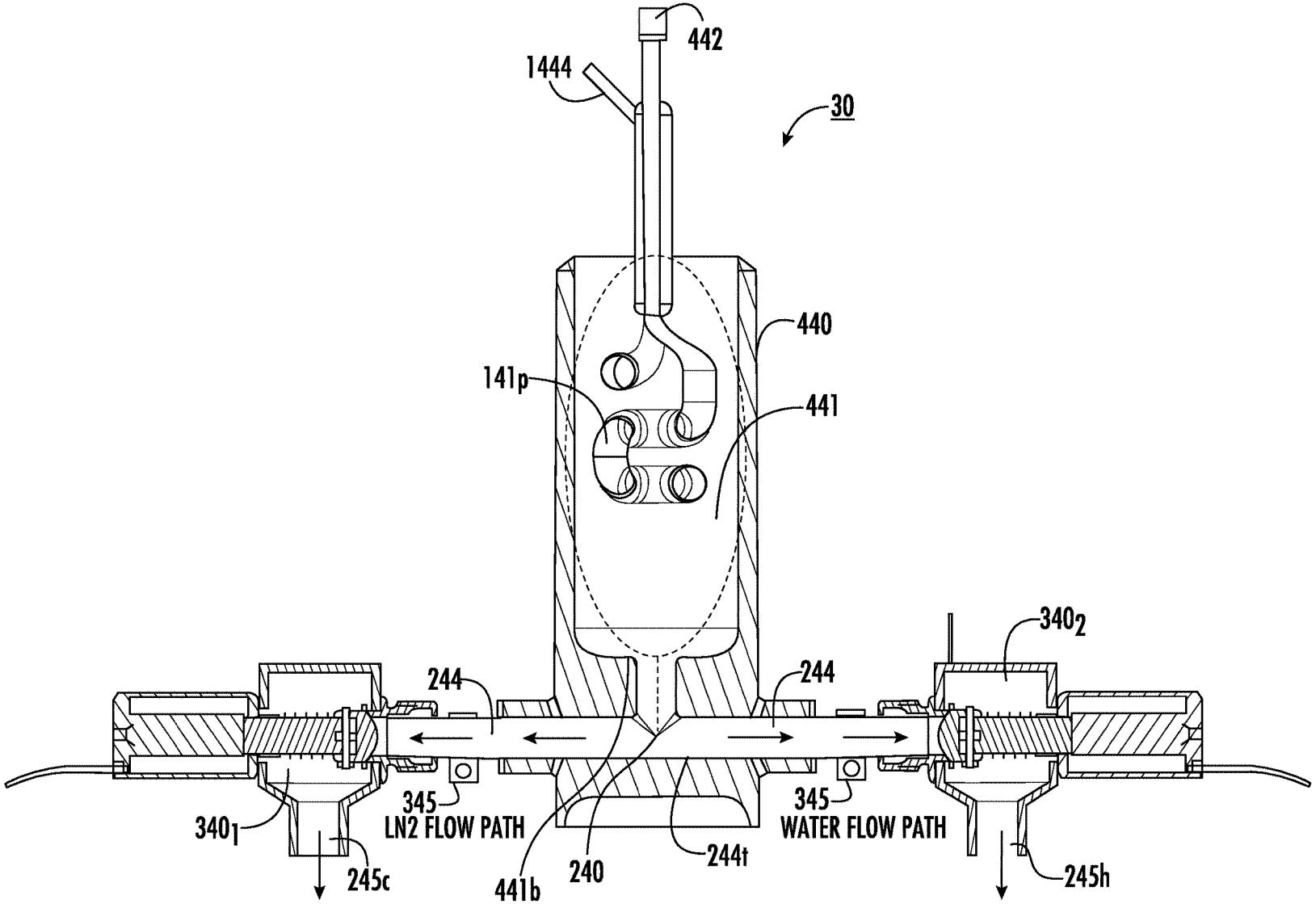
FIG. 3 is a partial section view of a portion of a cryo-collection system similar to that shown in FIG. 2 and also illustrating example drain flow paths according to embodiments of the present invention.
Figure 4A:
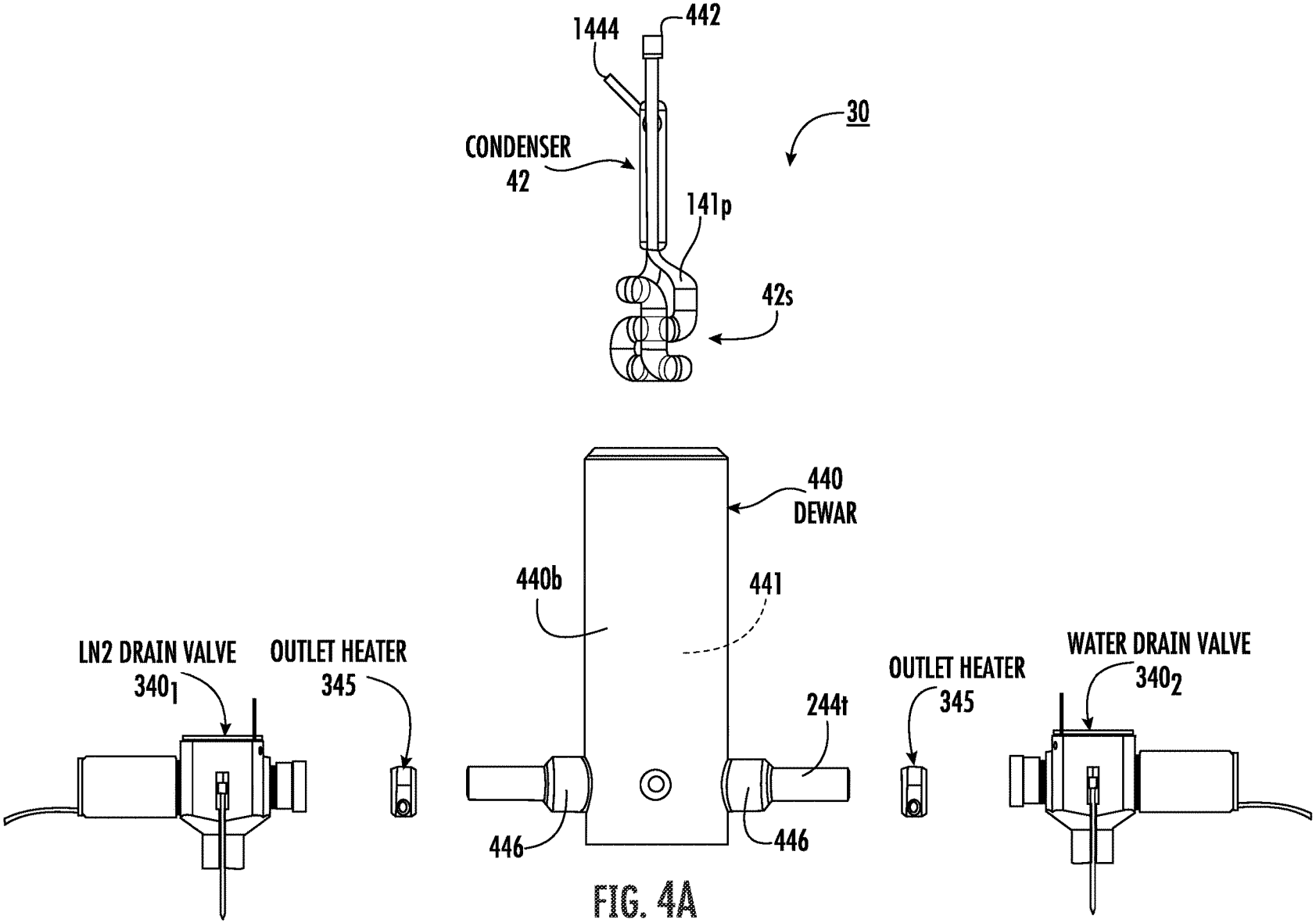
FIG. 4A is a partial exploded view of a portion of a cryo-collection system according to embodiments of the present invention.

FIGS. 3 and 4A illustrate that the drain path 244 can be provided by a single drain tube 244*t* that is in fluid communication with the drain port 240 and that can extend out diametrically opposing sides of the dewar body 440*b*. The dewar body 440*b* can comprise outer connectors 446 that sealably surround a respective portion of the tube 244*t*. The dewar body 440*b*, outer connectors 446 and drain tube 244*t* can be or comprise non-ferromagnetic metal such as stainless steel or aluminum.

Figure 5A:
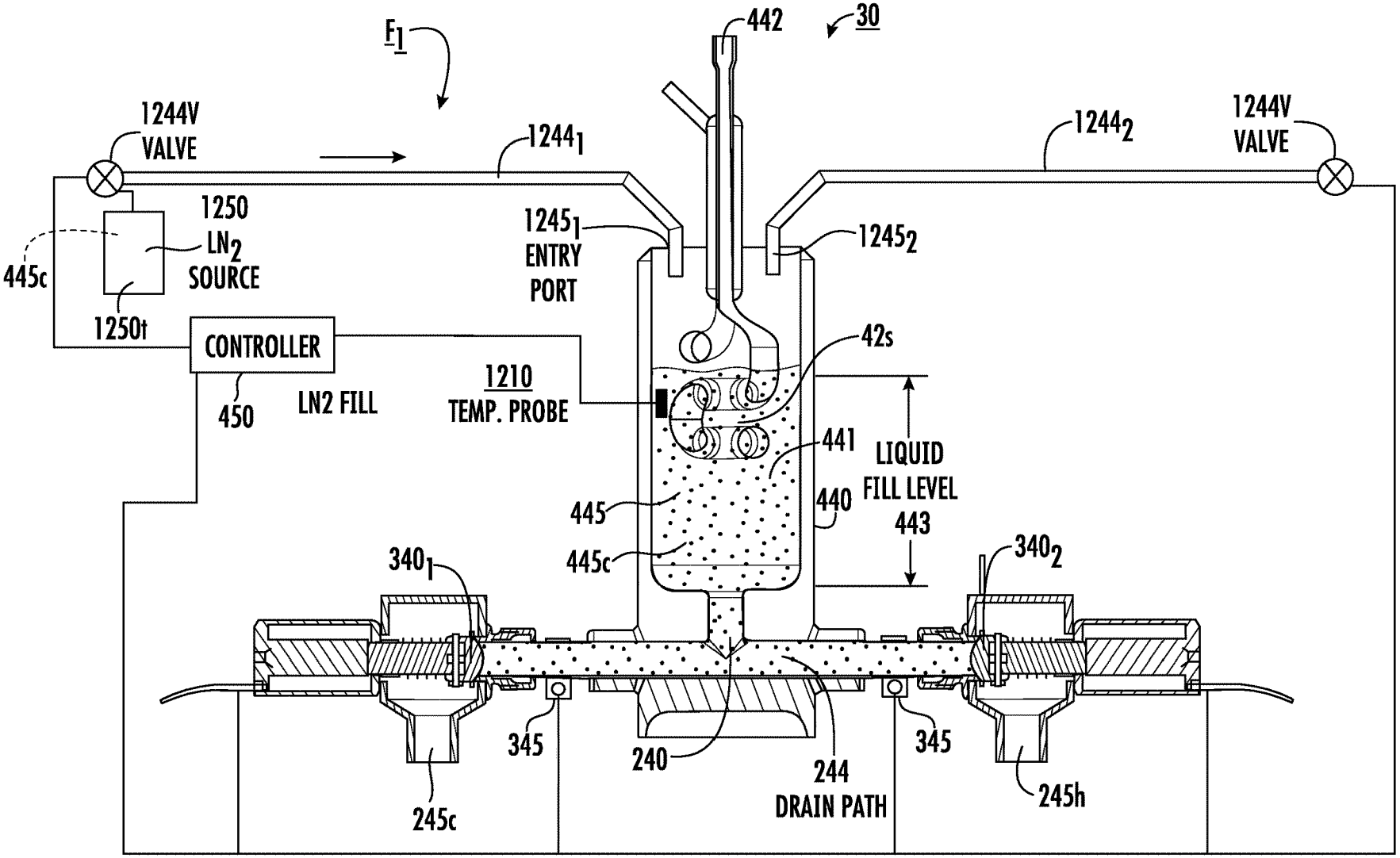
FIG. 5A is a partial schematic and section view of a portion of a cryo-collection system showing a first fluid flow path for providing a coolant liquid to cool the accumulator of the cryo-collection system for a freeze operation of $^{129}$xenon according to embodiments of the present invention.
Figure 5B:
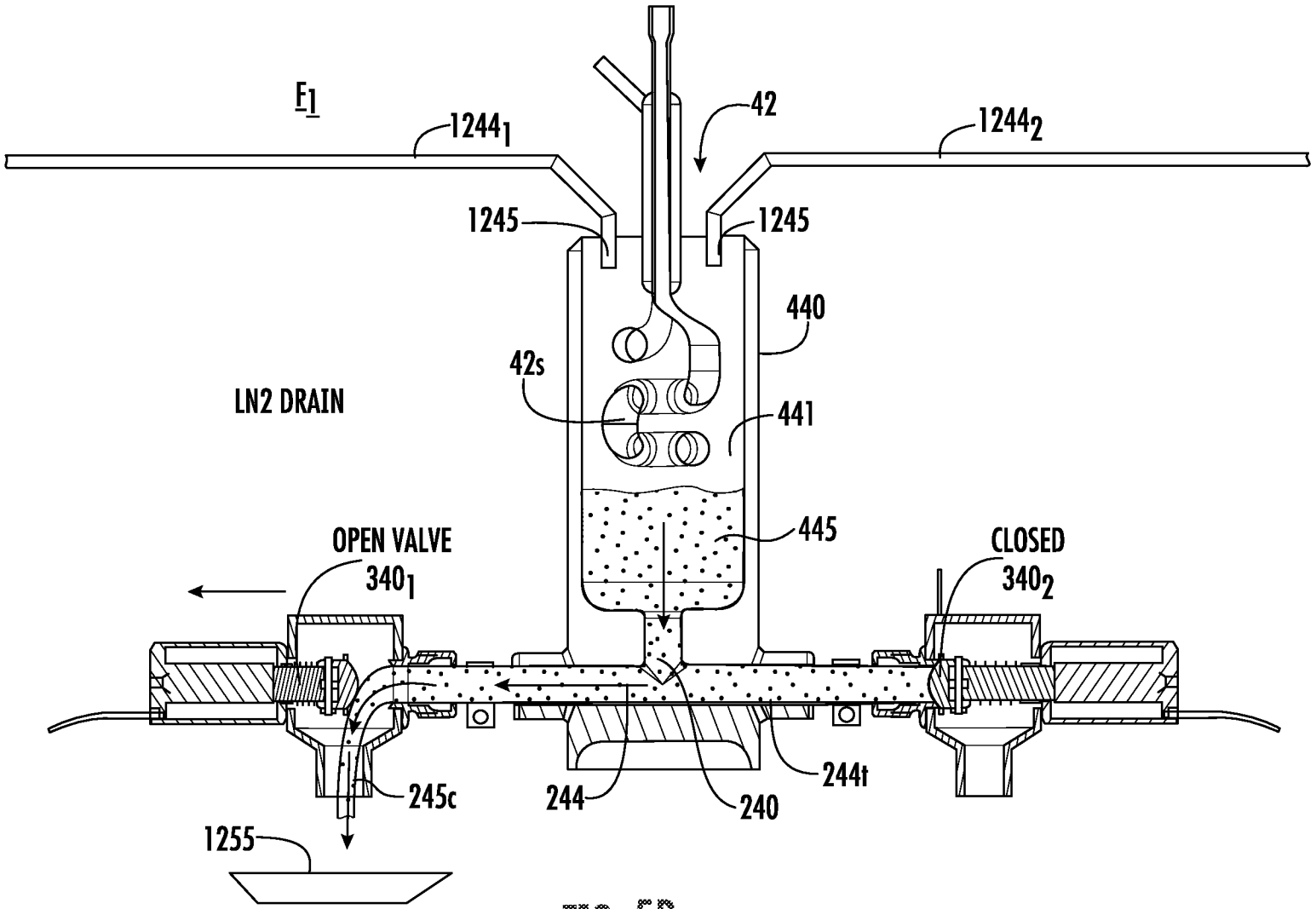
FIG. 5B illustrates the system shown in FIG. 5A to drain the coolant liquid to a drain path according to embodiments of the present invention.
Figure 6A:
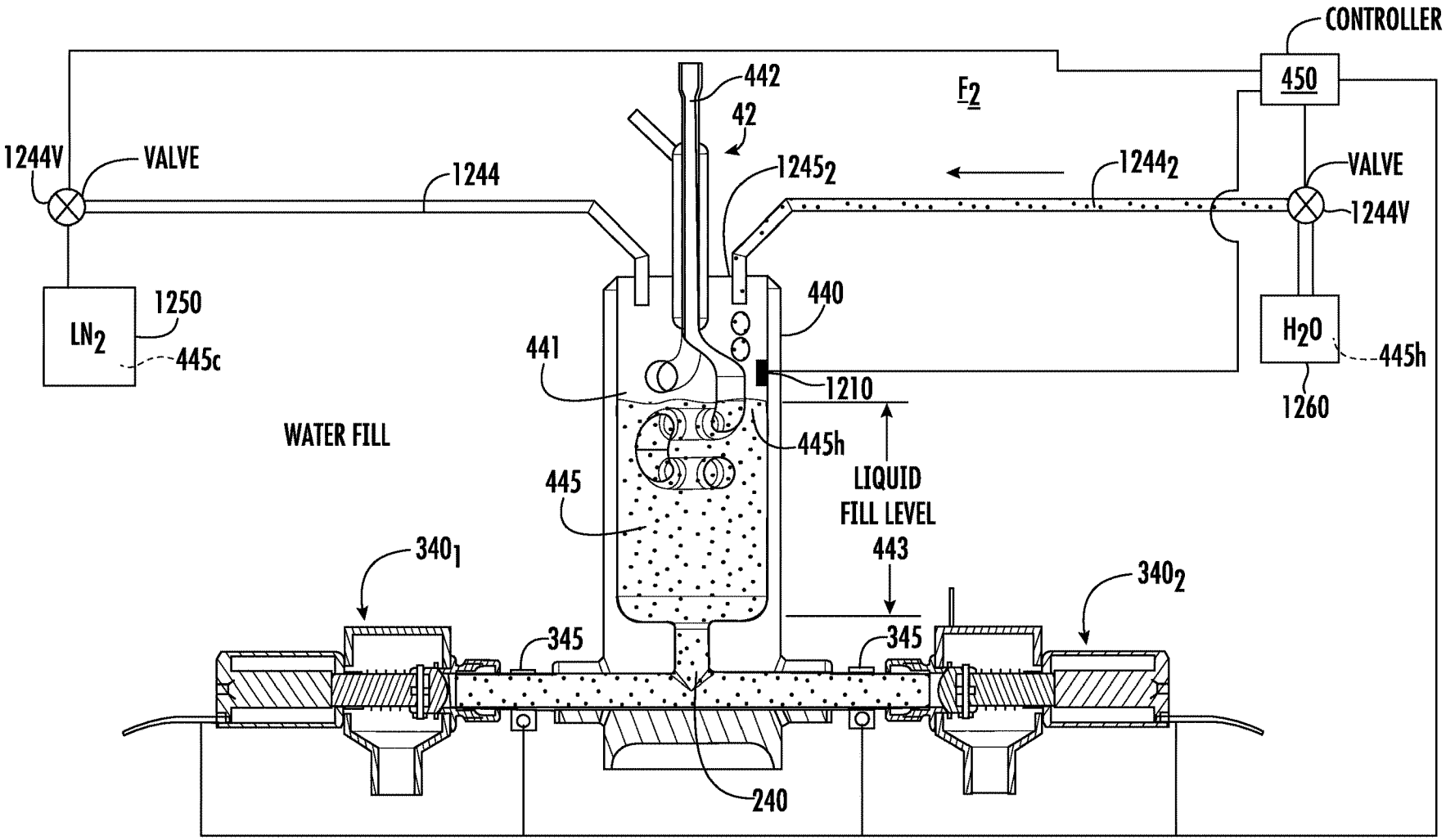
FIG. 6A is a partial schematic and section view of a portion of a cryo-collection system showing a second fluid flow path for providing a heated liquid to heat the accumulator of the cryo-collection system for a thaw operation of $^{129}$xenon according to embodiments of the present invention.

FIGS. 5A, 5B, 6A and 6B illustrate a sequence of operations to carry out the freeze and thaw actions according to embodiments of the present invention. The controller 450 can be coupled to the temperature probe 1210, the drain valves 340, the outlet heaters 345, and the fill valves 1244*v* (FIGS. 5A, 6A).

Referring to FIG. 5A, a first flow path F1 associated with the coolant liquid 445*c* provides the coolant liquid 445*c* from the coolant liquid source 1250 to a first liquid fill path $\mathbf{1244}_1$ to the first fill port $\mathbf{1245}_1$ to the chamber 441 to a desired fill level 443 for the freeze/collection of the $^{129}$Xe. The drain valves $\mathbf{340}_1$, $\mathbf{340}_2$ are in a closed position and the coolant liquid 445*c* also resides in the drain path 244 upstream of the drain valves $\mathbf{340}_1$, $\mathbf{340}_2$. As shown in FIG. 5B, the first drain valve $\mathbf{340}_1$ is then opened, the second drain valve $\mathbf{340}_2$ remains closed, and the coolant liquid 445*c* is drained via the drain port 240*p* to the drain path 244 between the first drain valve $\mathbf{340}_1$ and the drain port 240. The drained liquid coolant 445*c* then exits the drain tube 244*t* via a discharge path 245*c* downstream of the first drain valve $\mathbf{340}_1$ to a discharge vessel 1255 such as an evaporation tray.

Figure 6B:
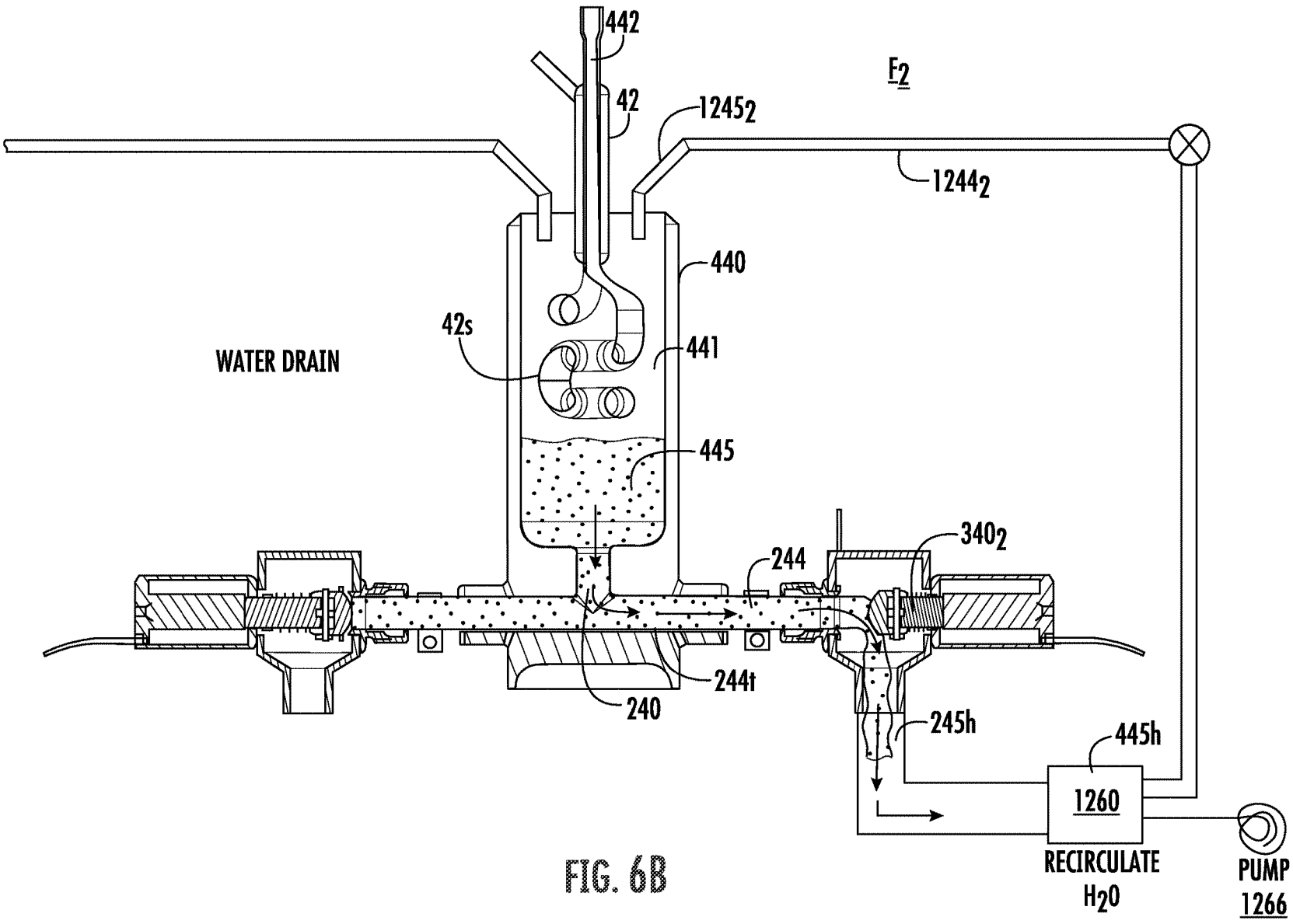
FIG. 6B illustrates the system shown in FIG. 6A to drain the heated liquid to a drain path according to embodiments of the present invention.

Referring to FIG. 6A, a second flow path F2 associated with the heated liquid 445*h* provides the heated liquid 445*h* from the heated liquid source 1260 to a second liquid fill path $\mathbf{1244}_2$ to the second fill port $\mathbf{1245}_2$ to the chamber 441 to a desired fill level 443 for the thaw of the collected $^{129}$Xe. The drain valves $\mathbf{340}_1$, $\mathbf{340}_2$ are in a closed position and the heated liquid 445*h* also resides in the drain path 244 upstream of the drain valves $\mathbf{340}_1$, $\mathbf{340}_2$. As shown in FIG. 6B, the second drain valve $\mathbf{340}_2$ is then opened, the first drain valve $\mathbf{340}_1$ remains closed, and the heated liquid 445*h* is drained via the drain port 240*p* to the drain path 244 between the second drain valve $\mathbf{340}_2$ and the drain port 240. The drained heated liquid 445*h* then exits the drain tube 244*t* to a discharge path 245*h* downstream of the second drain valve 3402. As shown, the drained heated liquid 445*h* then flows back to the heated liquid source 1260.

Figure 7:
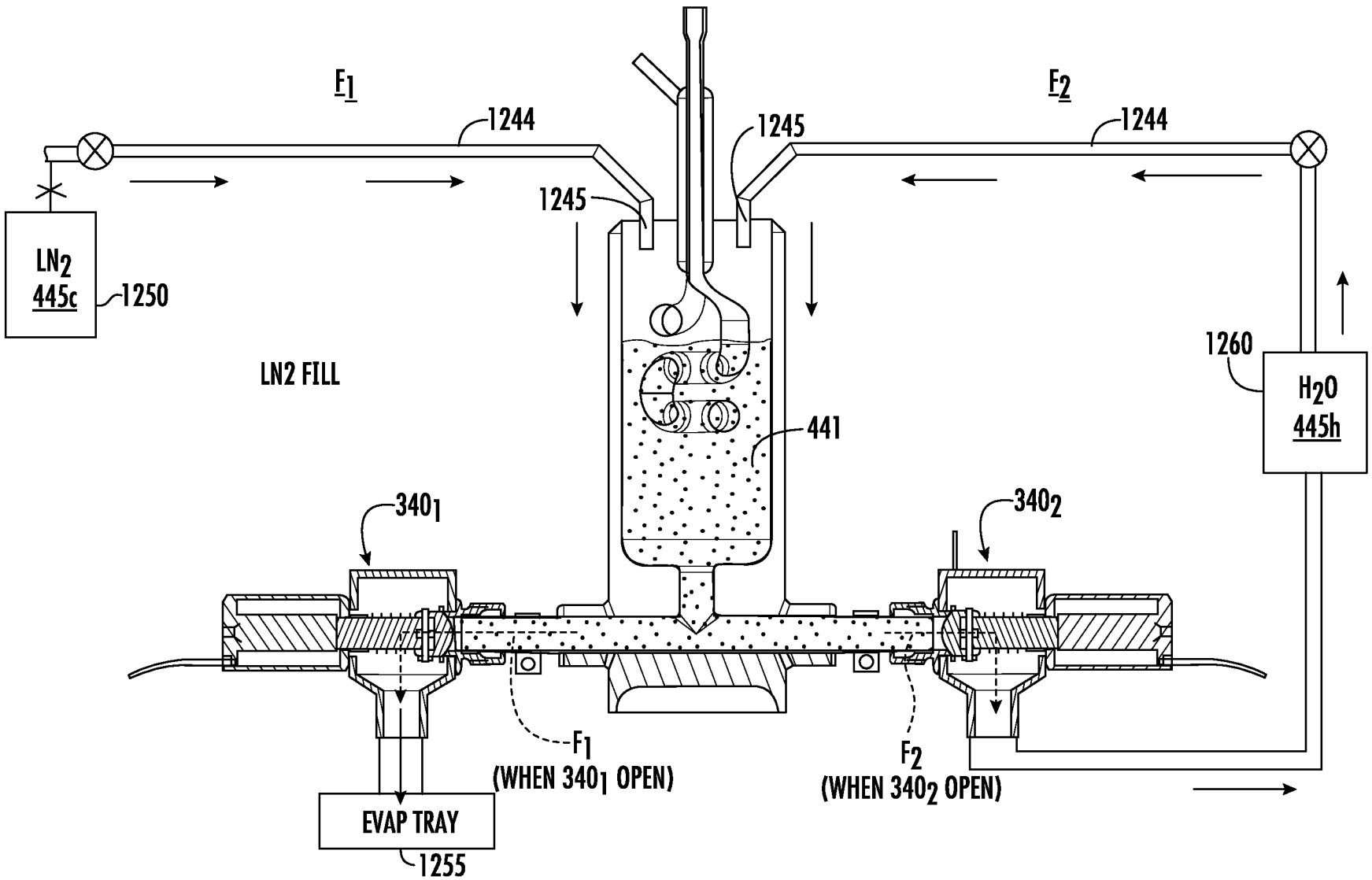
FIG. 7 is a schematic illustration of a cryo-collection system showing first and second fluid flow paths with different drain destinations for the coolant liquid and the heated liquid from the chamber of the dewar according to embodiments of the present invention.

FIG. 7 schematically illustrates a simplified version of FIGS. 5A, 5B, 6A, 6B and shows the first and second flow paths F1, F2 with corresponding arrows indicating flow direction (the discharge flow corresponding to when the respective drain valve 340 is open).

It is noted that separate controllers 450 or a common controller 450 may be used to control operation of the different cryo-collectors $\mathbf{30}_1$, $\mathbf{30}_2$. Also, more than one controller 450 may be used to control operation of different components of a respective cryo-collector 30.

Figure 9:
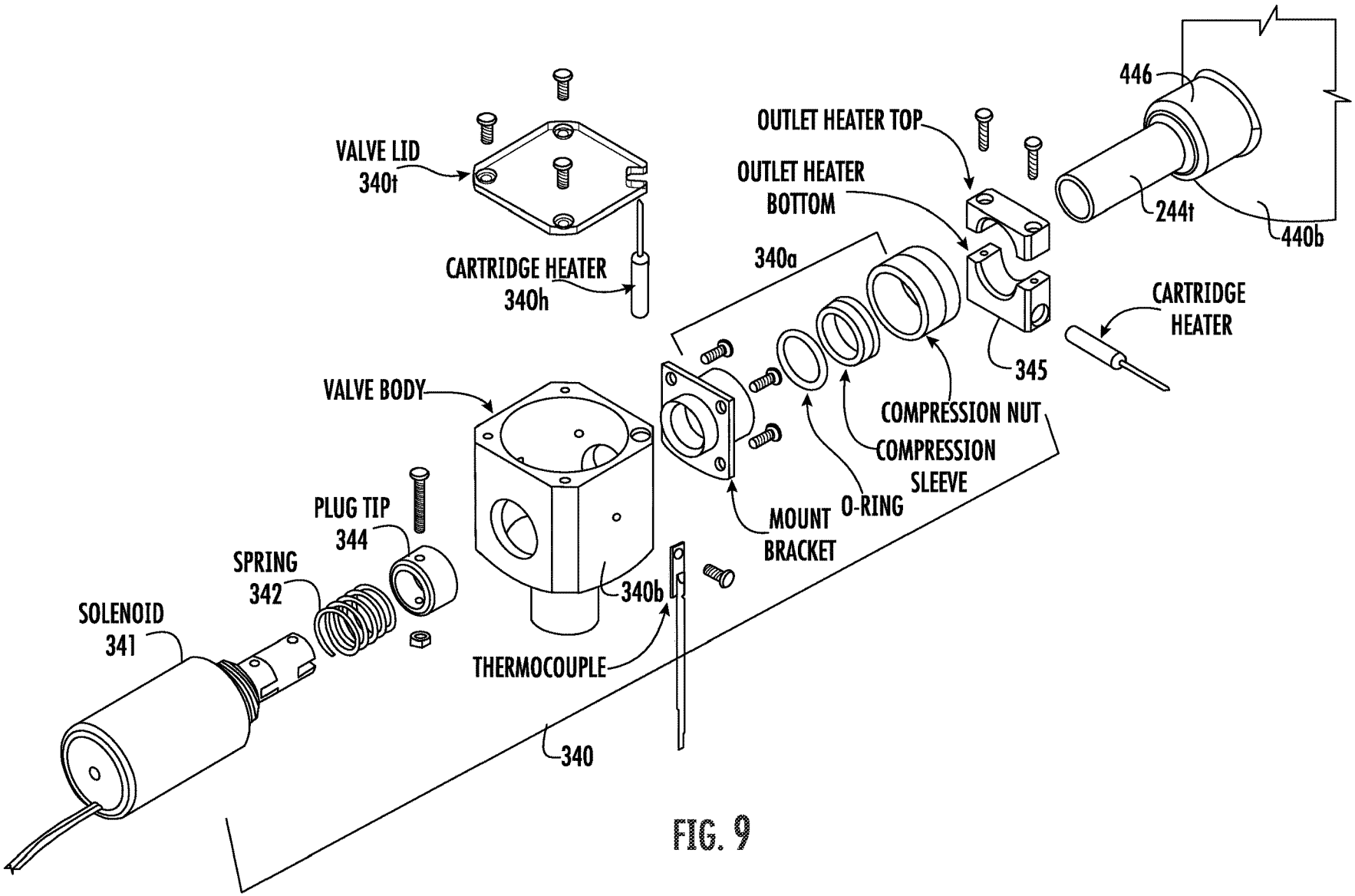
FIG. 9 is an exploded view of components of the drain path according to embodiments of the present invention.

FIG. 9 is an exploded view of an example drain valve 340 and outlet heater 345. The drain valve 340 comprises a solenoid 341, spring 342, plug tip 344 and valve body 340*b*. The solenoid 341 can linearly translate to move the plug tip 344 from open and closed positions. The drain valve 340 can also include a lid 340*t* with a cartridge heater 340*h*. The drain valve 340 can also comprise a mounting assembly 340*a* comprising a mounting bracket, compression sleeve, compression nut and O-ring as shown. However, other drain valve configurations may be used.

A typical single bolus of $^{129}$Xe for inhalation can be in a range of 250 mL to 750 mL. The accumulator 42 can be configured to collect the bolus amount or multiple bolus amounts (which can be subsequently divided into different dose delivery containers) during a respective freeze/thaw cycle and may have a maximum capacity of 1-1.5 liters (gaseous state), in some embodiments.

The cryo-collection system 30 provides the coolant liquid 445*c* to the chamber 441 as the hyperpolarized gas mixture flows through the inlet conduit 442 into the accumulator 42 and the nitrogen and helium vent out the outlet conduit 444. During collection, valves 35, 37 and 58 are open, and the flow control device (e.g., valve) 57 is adjusted for the desired flow rate (FIGS. 1A/1B). When a thaw of the collected $^{129}$Xe is desired, the incoming or isolation valve 35 (FIGS. 1A/1B) is closed along with valve 58, and valve 47 and 50*b* or 50*c* are opened, the controller 450 opens valve 1244*v* in the second flow path F2 to provide the heated liquid 445*h* to the chamber 441 whereby collected frozen $^{129}$Xe is thawed and flowed out the outlet conduit 444 to a container such as a collection vessel 155 such as a TEDLAR bag at the Xe outlet 50*b* for dispensing to a patient. In some embodiments, a pre-collection container 255 can be used to collect, measure and add $N_2$ from a medical grade high pressure $N_2$ source 152, such as a pressurized cylinder in communication with a regulator 153, to the thawed $^{129}$Xe gas, then the measured amount can be dispensed to a single or multiple bolus collection container 155 such as a flexible bag which can be a TEDLAR bag for transportation to a use cite and dispensing to a patient. To allow the use of the pre-collection container 255, the valve 50*c* is open during the thaw. Valve 52 can be closed to prevent the gas mixture from mixing with nitrogen gas during collection. When starting a thaw, the coolant liquid, e.g., LN2, in the dewar 444 is drained onto the discharge container, e.g., evaporation pan, before the heated liquid is provided to the dewar 444.

It is noted that, the present invention is not limited to any particular (hyper) polarizer configuration, embodiments of the invention are particularly suitable for high-volume, flow polarizer systems. These systems can take on various forms and use various components as is known to those of skill in the art. To be clear, different components and arrangements may be used and not all components shown are required.

Thus, referring again to FIG. 1A, as is known by those of skill in the art, this figure illustrates an example of a modified compact flow-through high volume hyperpolarizer which is configured to (continually over a production run) produce and accumulate spin-polarized noble gases, i.e., the flow of gas through the unit is substantially continuous. As shown, the hyperpolarizer 10 includes a noble gas ($^{129}$Xe) supply or gas mixture source 12 and a supply regulator 14. A purifier 16 can be positioned in the line to remove impurities such as water vapor from the system as will be discussed further below. The hyperpolarizer 10 can also include a flow meter 18 and an inlet valve 20 positioned upstream of the optical (polarizer) cell 22, typically also upstream of the pre-saturation chamber 200. An optic light source such as a laser 26 (either narrow or broad band, typically a diode laser array) is directed into the polarizer cell 22 through various focusing and light distributing means 24, such as lenses, mirrors, and the like. The light source is circularly polarized to optically pump the alkali metals in the optical pumping cell 22. An additional valve 28 can be positioned downstream of the optical pumping/polarizer cell 22.

Next in line, is the cryo-collection system 30. The cryo-collection system 30 can be connected to the hyperpolarizer 10 by a pair of releasable mechanisms such as threaded members or quick disconnects 31, 32. This allows the cryo-collection system 30 to be easily detached, removed, or added, to and from the hyperpolarizer 10.

FIG. 1B illustrates that the hyperpolarizer 10 has first and second cryo-collection systems $\mathbf{30}_1$, $\mathbf{30}_2$, each can be serially operable to alternately collect the hyperpolarized $^{129}$Xe from the gas mixture exiting the optical pumping cell 22. Alternating between the use of the first and second cryo-collection systems $\mathbf{30}_1$, $\mathbf{30}_2$, can reduce or eliminate deadtime between successive collections of hyperpolarized $^{129}$Xe from the gas mixture from the optical pumping cell 22.

A vacuum pump 60 is in fluid communication with the system 10 and may be in communication with a vacuum transducer 61. Additional valves to control flow and direct exit gas can be used and are shown at various points (shown as 52, 55). A shut-off valve 47 can be positioned adjacent an "on-board" outlet/exit gas tap 50. Certain of the valves downstream of the cryo-collector 30 can be used for "on-board" thawing and delivery of the collected polarized gas. The hyperpolarizer 10 can also include a digital pressure transducer 54 and a flow control device 57 along with a shut-off valve 58. The shut-off valve 58 can control the flow of gas through the entire system or hyperpolarizer 10 and can be used to turn the gas flow on and off. As will be understood by those of skill in the art, other flow control mechanisms, devices (analog and electronic) may be used within the scope of the present invention.

In operation, a gas mixture is introduced into the system at the gas source 12. As shown in FIG. 1A, the gas source 12 is a pressurized gas tank which holds a pre-mixed gas mixture. The gas mixture includes a lean noble gas (the gas to be hyperpolarized) and buffer gas mixture. Preferably, for producing hyperpolarized $^{129}$Xe, the pre-mixed gas mixture is about 90% He, about 5% or less $^{129}$Xe (typically about 1% $^{129}$Xe), and about 10% $N_2$. The gas mixture can be passed through the purifier 16 and introduced into the optical (polarizer) cell 22. The valves 20, 28 are on/off valves operably associated with the polarizer cell 22. The gas regulator 14 steps down the pressure from the gas source 12 (typically operating at 2000 psi or 136 atm) to about 1-10 atm for the system, e.g., about 1 atm, about 2 atm, about 3 atm, about 4 atm, about 5 atm, or between about 6-10 atm for the system. For systems with spectrally narrowed lasers, lower cell operating pressures of between about 1-3 atm may be particularly desirable.

Thus, during accumulation, the entire manifold (conduit, polarized cell, accumulator, etc.) can be pressurized to the cell pressure (e.g., about 3 atm). The flow in the hyperpolarizer 10 can be activated by opening valve 58 and is controlled by adjusting the flow control device 57. The typical residence time of the gas mixture in the optical pumping cell 22 is about 10-30 seconds; i.e., it takes on the order of 10-30 seconds for the gas mixture to be hyperpolarized while moving through the optical pumping cell 22.

For lightweight accumulators 42, the gas mixture is typically introduced into the optical pumping cell 22 at a pressure of between about 1-3 atm and this pressure is about the same as that at the accumulator 42.

Of course, with hardware capable of operating at increased pressures, operating pressures of above 10 atm, such as about 20-30 atm can pressure broaden the Rb and absorb up to 100% of the optical light. In contrast, for laser linewidths less than conventional linewidths, lower pressures can be employed. The polarizer cell 22 can be a high-pressure optical pumping cell housed in a heated chamber with apertures configured to allow entry of the laser emitted light.

As noted above, various techniques have been employed to accumulate and capture polarized gases for use in MRI imaging of patients. For example, U.S. Pat. No. 5,642,625 to Cates et al., describes a high volume hyperpolarizer for spin polarized noble gas and U.S. Pat. Nos. 5,860,295; 5,809,801; 6,305,190; and 6,735,977 describe cryogenic accumulators for spin-polarized $^{129}Xe$. These references are hereby incorporated by reference as if recited in full herein. As used herein, the terms "hyperpolarize" and "polarize" and the like, mean to artificially enhance the polarization of certain noble gas nuclei over the natural or equilibrium levels. Such an increase is desirable because it allows stronger imaging signals corresponding to better MRI images of the substance and a targeted area of the body. As is known by those of skill in the art, hyperpolarization can be induced by spin-exchange with an optically pumped alkali-metal vapor or alternatively by metastability exchange. See Albert et al., U.S. Pat. No. 5,545,396, which is incorporated by reference as if recited in full herein.

Turning again to FIG. 1A, an example hyperpolarizer 10 is shown that may include at least one pre-saturation chamber 200. The chamber 200 can be relatively compact and can reside adjacent the entry port of the optical pumping cell 22. The hyperpolarizer 10 can include other components as is known by those of skill in the art (and are described below). The term "chamber" with respect to the pre-sat member and/or section of the gas flow path, refers to a region of a flow path that flowably supplies noble gas mixture into the optical pumping cell 22 with vaporized alkali metal. Thus, the pre-saturation chamber 200 is configured to house alkali metal that is vaporized and introduced into a flowing noble gas mixture, then into the optical pumping cell 22. The pre-saturation chamber 200 can be a detachable component or an integral part of the flow path. The pre-saturation chamber 200 can have an Area Ratio ("AR") of surface area to cross-sectional area that is between 20 and 500, more typically between 20 and 200 as will be discussed below.

In some embodiments, the chamber 200 can be tubular and have a short length such as about between about 0.5 inches to about 2 inches, typically about 1.25 inches.

Optionally, the optical pumping cell 22 can include pairs of conduit legs 22*a*, 22*b* that extend to valves V, e.g., 20, 28 (which are typically KONTES valves).

The optical pumping cell 22 can be relatively compact with a volume capacity of between about 100 cc to about 500 cc, such as about 100 cc, about 200 cc, about 300 cc, about 400 cc and about 500 cc. The optical pumping cell 22 can also have larger sizes, such as between about 500 cc-1000 cc, for example. The chamber 200 can have a length L that is between about 0.5 inches to 6 inches long, typically between about 1-3 inches, such as about 1.25" long. The chamber 200 can have a primary body segment with a cross-sectional height W (e.g., diameter, when tubular) that can be between about 0.25 inches to about 1 inch across, typically about 0.5".

The pre-saturation chamber 200 can contain between about 0.25 g to about 5 grams of Rb, typically between about 0.5 to about 1 gram of Rb, (measured "new" as shipped by an OEM or supplier and/or prior to a first use).

As shown in FIG. 1A, the hyperpolarizer 10 can comprise at least two different temperature-controlled zones T1, T2, one (T1) for the pre-saturation chamber 200 and at least one other (T2) for the optical pumping cell 22 so that T1>T2. The volume of the pre-saturation chamber V1 is also less than the volume V2 of the optical pumping cell 22.

In some embodiments, the pre-saturation chamber 200 in the T1 zone can be heated to temperatures between about 140 degrees C. and 300 degrees C., more typically between about 140 degrees Celsius to about 250 degrees Celsius, such as 140 degrees C., 150 degrees C., 160 degrees C., 170 degrees C., 180 degrees C., 190 degrees C., 200 degrees C., 210 degrees C., 220 degrees C., 230 degrees C., 240 degrees C. and 250 degrees C. The second temperature zone (T2) for the optical pumping cell 22 can be configured to have a temperature that is less than T1, typically with a temperature between about 70 degrees C. to about 200 degrees C., more typically between about 90 degrees C. to about 150 degrees C., such as about 95 degrees C., about 100 degrees C., about 110 degrees C., about 120 degrees C., about 140 degrees C. and about 150 degrees C., to maintain vapor pressure, in some embodiments. The zone T2 may also be configured to apply a temperature gradient of decreasing temperature from a greater temperature at a region proximate the inlet to a lower temperature proximate the exit, typically with a change that is about 10 degrees C., about 15 degrees C., about 20 degrees C., about 25 degrees C. or about 30 degrees C., for example.

The temperature zone T1 can comprise at least one (pre) heater 222 that can provide the desired heat to increase the temperature including conductive and/or convection heaters. The at least one heater 222 can be an electric heater. The at least one heater 222 can comprise one or more of an oven, infrared heaters, resistive heaters, ceramic heaters, heat lamps, heat guns, laser heaters, heat blankets (e.g., heat blanket that can be wrapped about the chamber 200 with at least one insulation layer, typically comprising Nomex®—fiberglass fibers, but other insulation materials may be used), pressurized hot fluid spray and the like. The at least one heater 222 can employ a plurality of different heater types. The at least one heater 222 can comprise an oven that encases or partially encases the chamber 200. The at least one heater 222 can comprise an internal heater in the chamber 200. The temperature zone T2 can also comprise at least one heater 122, typically comprising an oven. Each zone can be independently controlled to maintain a desired temperature or temperatures.

The hyperpolarizer 10 can be configured so that alkali metal is loaded only into the pre-saturation chamber 200 that is outside of the pumping laser exposure region of the optical pumping cell 22.

The optical cell 22 can be mounted to a vacuum manifold and the alkali metal A (e.g., Rb) can be "chased" into the pre-saturation chamber 200. The optical pumping cell 22 can then be operated in a modified conventional high-volume hyperpolarizer 10 where heat is applied primarily to the pre-saturation chamber 200 and to a lesser (cooler degree) to the optical cell 22.

In some particular embodiments, in contrast to a normal optical pumping cell 22 maintained at between 160-180 degrees C., the optical cell 22 can be held at a primary body temperature that is maintained at 150 C or less, such as between 100 C and 150 C, including, for example, about 100 degrees C., about 110 degrees C., about 120 degrees C., about 130 degrees C., about 140 degrees C., while Rb saturated vapor is picked up by the flowing gas stream in the pre-saturation chamber 200, which can be maintained at temperatures ranging from between about 150 to 250 degrees C., depending on the desired flow rates. In some particular embodiments, the pre-saturation ("pre-sat") chamber 200 can be held at between 150 degrees C. to about 160 degrees C.

In some embodiments, the hyperpolarizer 10 employs an optical pumping cell 22 at a pressure of about 3 atm. It is contemplated that a spectrally narrowed laser, that has been detuned by about 0.25-0.50 nm from the alkali D1 resonance at that pressure. As will be understood by one of skill in the art, a small pressure shift in resonance occurs from vacuum to the 3 atm pressure which can depend on the buffer gas composition. For example, in vacuum, Rb D1 resonance is at 794.8 nm, whereas at 3 atm with the same buffer gas mixture, it is shifted to a slightly lower wavelength of 794.96 nm.

The hyperpolarizer 10 can employ helium buffer gas to pressure broaden the Rb vapor absorption bandwidth. The selection of a buffer gas can be important because the buffer gas—while broadening the absorption bandwidth—can also undesirably impact the alkali metal-noble gas spin-exchange by potentially introducing an angular momentum loss of the alkali metal to the buffer gas rather than to the noble gas as desired.

Figure 4B:
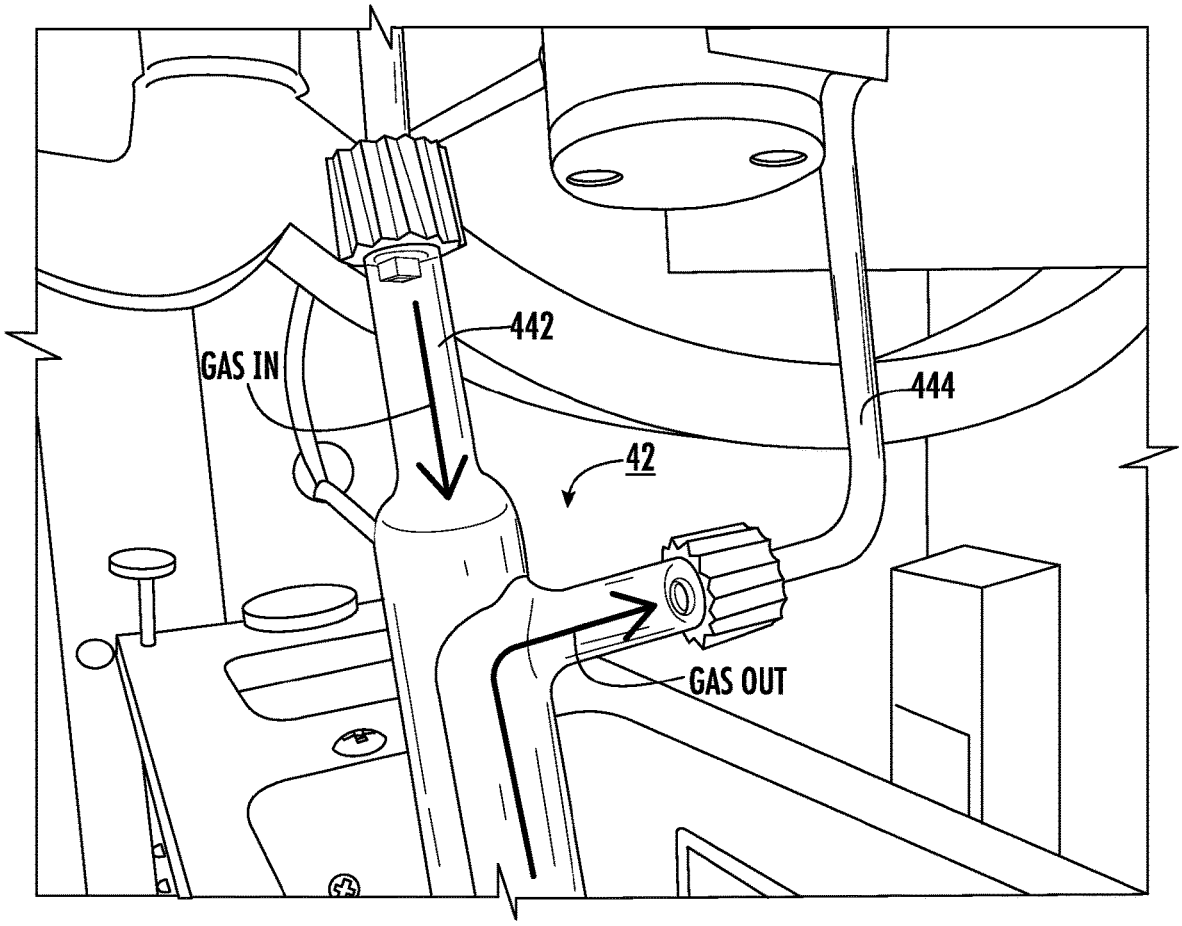
FIG. 4B is a side perspective view of a portion of the accumulator/cold finger of the cryo-collection system.

Hyperpolarized gas, together with the buffer gas mixture, exits the optical (polarizer) cell 22 and travels along the manifold (e.g., conduit), then enters the cryo-collection system 30. The gas mixture is directed into the accumulator 42 and along a gas mixture flow path 141*p*. As discussed above, in operation, the hyperpolarized $^{129}$Xe gas is exposed to temperatures below its freezing point and collected as a frozen product in the accumulator 42. The remainder of the gas mixture remains gaseous and exits the accumulator 42 through outlet conduit 444 (FIG. 4B). The hyperpolarized gas is collected in the accumulator 42 (as well as stored, transported, and preferably thawed) in the presence of a magnetic field, generally on the order of at least 500 Gauss, and typically about 2 kiloGauss, although higher fields can be used. Lower fields can potentially undesirably increase the relaxation rate or decrease the relaxation time of the polarized gas. The magnetic field can be provided by permanent magnets positioned about a magnetic yoke. Once a desired amount of hyperpolarized gas has been collected in the accumulator 42, valve 35 can be closed. The manifold of the hyperpolarizer 10 downstream of the valve 28 can be allowed to depressurize to about 1.5 atm before the flow valve 58 is closed. After closing the flow valve 58, valves 52 and 55 can be opened to evacuate the remaining gas in the manifold. Once the outlet plumbing is evacuated, valve 59 is closed. A receptacle/container such as a bag or other vessel 155 can be attached to the outlet 50*b*. Valves 47, 50*b*, 52 and 55 can be opened to evacuate the attached bag 155.

In some embodiments, referring to FIGS. 1A/1B, the manifold can be configured to pull a vacuum on the bag (or vessel into which to $^{129}$Xe is to be expanded) during the entire collection time. In this configuration, the valve 59 is closed during flow, and valves 47, 50*b*, 52 and 55 are open. In this configuration, valves 52 and 55 are closed during the thaw so that thawed $^{129}$Xe gas is not lost to the vacuum pump.

If the valve 52 is not closed, then valve 55 is preferably closed to prevent the evacuation of polarized thawed gases. The flow channels on the downstream side of the cell 22 can be formed from materials which minimize the decaying effect on the polarized state of the gas. Coatings can also be used such as those described in U.S. Pat. No. 5,612,103, the disclosure of which is hereby incorporated by reference as if recited in full herein. In the "on-board" thaw operation, valve(s) 37 in the exit flow path is opened to let the gas out. It then proceeds through valve 47 and out outlet 50*b* or 50*c*.

Examples of suitable isolation valves 35, 37 and/or for valves V for the pre-sat chamber 200 (FIGS. 1A, 1B), include Swagelok valves or KIMBLE KONTES valves.

In some embodiments, the isolation valves 35, 37 are in communication with the primary flow channel and the (buffer gas) outlet conduit/exit channel 444, respectively, and each can adjust the amount of flow therethrough as well as close the respective paths to isolate the accumulator from the hyperpolarizer system 10 and the environment.

As will be appreciated by one of skill in the art, embodiments of the invention may be embodied as a method, system, data processing system, or computer program product. Accordingly, the present invention may take the form of an entirely software embodiment or an embodiment combining software and hardware aspects, all generally referred to herein as a "circuit" or "module." Furthermore, the present invention may take the form of a computer program product on a non-transient computer usable storage medium having computer usable program code embodied in the medium. Any suitable computer readable medium may be utilized including hard disks, CD-ROMs, optical storage devices, a transmission media such as those supporting the Internet or an intranet, or magnetic or other electronic storage devices.

Computer program code for carrying out operations of the present invention may be written in an object-oriented programming language such as Java, Smalltalk, PYTHON, C# or C++. However, the computer program code for carrying out operations of the present invention may also be written in conventional procedural programming languages, such as the "C" programming language or in a visually oriented programming environment, such as LABVIEW or Visual Basic.

Certain or all aspects of the program code may execute entirely on one or more of a user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider). Typically, some program code executes on at least one web (hub) server and some may execute on at least one web client and with communication between the server(s) and clients using the Internet. The polarizer control systems can be provided using cloud computing which includes the provision of computational resources on demand via a computer network. The resources can be embodied as various infrastructure services (e.g., compute, storage, etc.) as well as applications, databases, file services, email, etc. In the traditional model of computing, both data and software are typically fully contained on the user's computer; in cloud computing, the user's computer may contain little software or data (perhaps an operating system and/or web browser) and may serve as little more than a display terminal for processes occurring on a network of external computers. A cloud computing service (or an aggregation of multiple cloud resources) may be generally referred to as the "Cloud." Cloud storage may include a model of networked computer data storage where data is stored on multiple virtual servers, rather than being hosted on one or more dedicated servers.

The invention is described in part below with reference to flowchart illustrations and/or block diagrams of methods, systems, computer program products and data and/or system architecture structures according to embodiments of the invention. It will be understood that each block of the illustrations, and/or combinations of blocks, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions may also be stored in a computer readable memory or storage that can direct a computer or other programmable data processing apparatus to function in a particular manner, such that the instructions stored in the computer readable memory or storage produce an article of manufacture including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowcharts and block diagrams of certain of the figures herein illustrate exemplary architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order or two or more blocks may be combined, depending upon the functionality involved.

Figure 10:
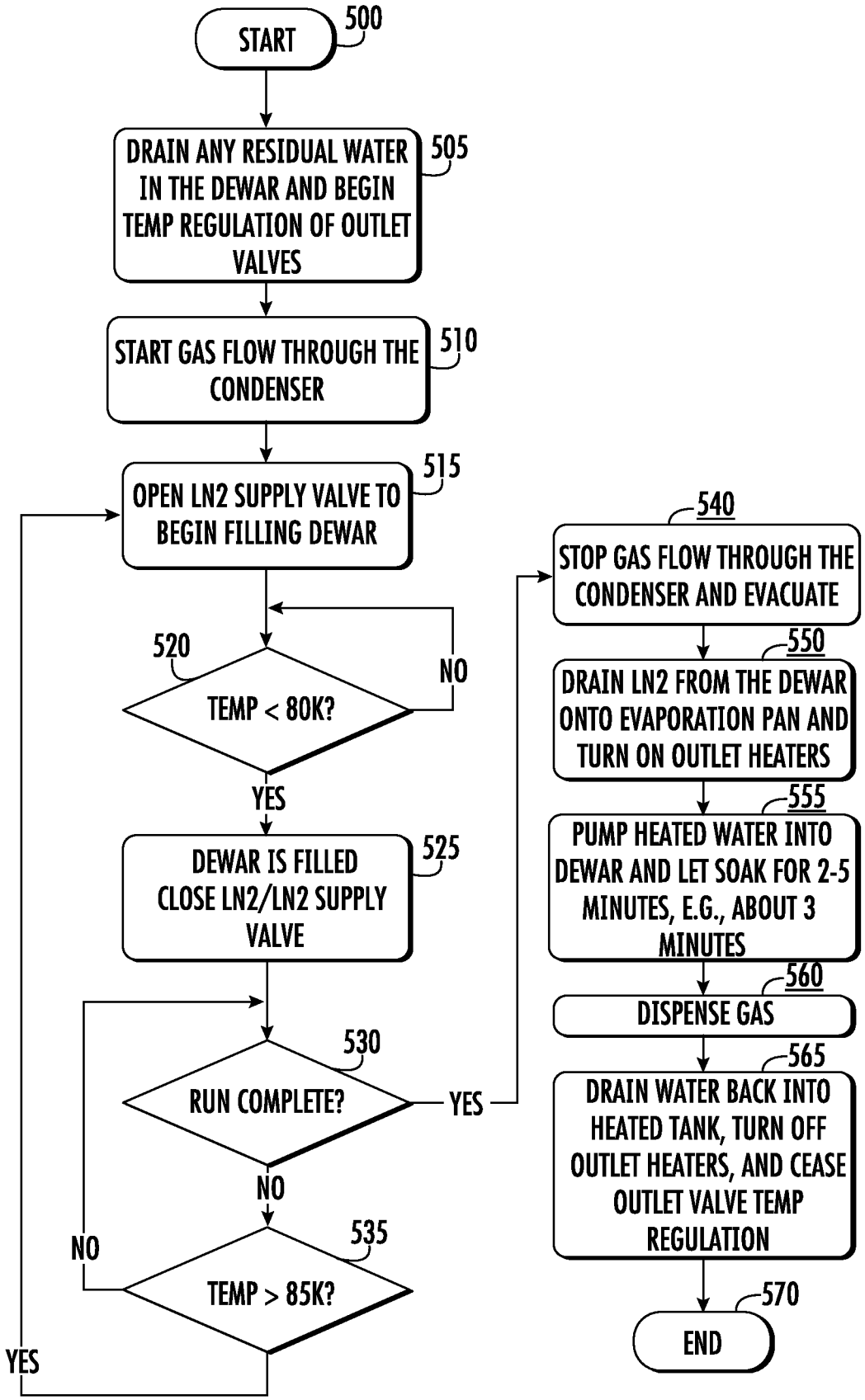
FIG. 10 is a flow chart of example actions for a freeze/thaw process according to embodiments of the present invention.

FIG. 10 is a flow chart of example actions that can be used to collect/dispense hyperpolarized $^{129}$Xe. At the start (block 500) of a freeze cycle for accumulation/collection of $^{129}$Xe from a hyperpolarized noble gas mixture, at least where there are multiple such collections carried out during any production cycle, residual water from the heated liquid can be drained from the dewar (chamber) and temperature regulation and outlet (drain) valves initiated (block 505). The drain valves can be held at about room temperature (such as at about 30 deg C.) to inhibit freezing issues. Each drain valve can be individually heated/controlled using a respective thermocouple and cartridge heater, for example.

The hyperpolarized noble gas ($^{129}$Xe gas) mixture is allowed to start to flow through the accumulator (block 510). The LN2 supply valve is opened to begin filling the chamber of the dewar (block 515). Temperature is monitored in the chamber and if the temperature is less than 80 deg. Kelvin (K) (block 520), the dewar chamber is sufficiently filled, and the LN2 supply valve is closed (block 525). Flow the hyperpolarized noble gas mixture through the accumulator until the collection cycle/run complete (block 530). If the temperature rises above 85 deg. K (block 535), then open the LN2 supply valve to deliver additional LN2 to the dewar chamber (block 515) to reduce the temperature to under 80 deg K.

Once the collection of the frozen $^{129}$Xe from the hyperpolarized gas mixture is complete, stop the hyperpolarized gas mixture flow through the accumulator (block 540) and evacuate the gas flow path of the accumulator. That is, the remaining gases in the gas mixture (e.g., helium and nitrogen) are evacuated before thawing the $^{129}$Xe.

The LN2 is drained from the dewar chamber (from the drain port through the open drain valve) onto an evaporation pan and turn on the outlet heaters (block 550) coupled to the drain path downstream of the drain port of the dewar chamber.

The heated water is pumped into the dewar chamber to a desired fill level and let the heated water remain in the chamber for a desired soak period, typically about 2-5 minutes, such as about 3 minutes (block 555).

Dispense the thawed $^{129}$Xe gas from the accumulator (block 560).

Drain the water back into the heated tank, turn off the outlet heaters, cease outlet valve temperature regulation (block 565). A respective freeze/thaw cycle is complete.

Figure 11:
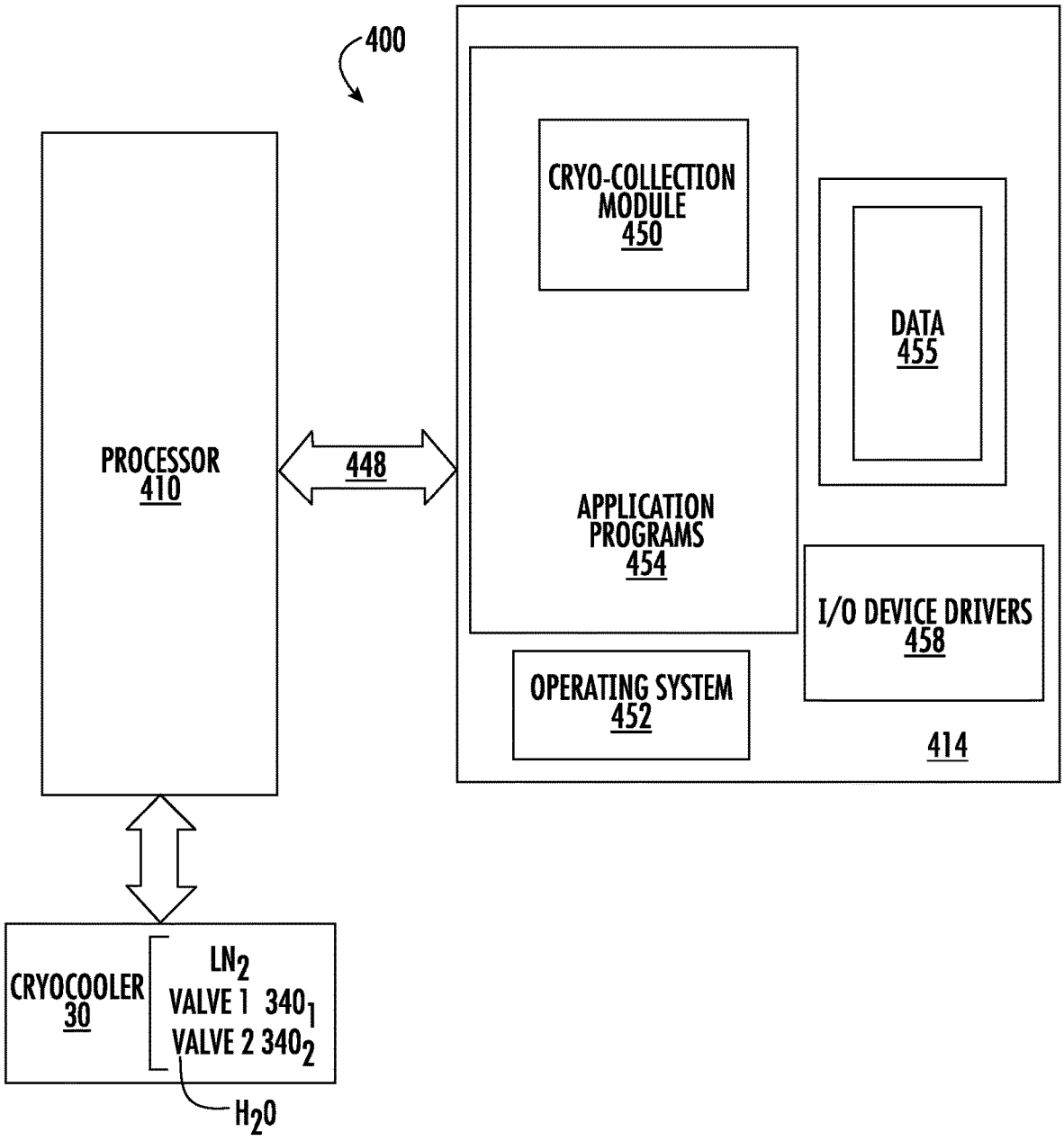
FIG. 11 is a schematic of a data processing system having a cryo-collection temperature control circuit and/or module according to embodiments of the present invention.

FIG. 11 is a schematic illustration of a circuit or data processing system 400. The circuits and/or data processing systems 400 may be incorporated in a digital signal processor in any suitable device or devices. As shown in FIG. 11, the processor 410 communicates with and/or is integral with the hyperpolarizer 10 and with memory 414 via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

FIG. 11 illustrates that the memory 414 may include several categories of software and data used in the data processing system: the operating system 452; the application programs 454; the input/output (I/O) device drivers 458; and data 455. The data 455 can include desired freeze collection amounts of $^{129}$Xe for various flow rates into the accumulator, synchronizing timing of manifold valves for ON/OFF position, drain valve and fill valve synchronization actions for accumulation and thaw and the like.

As will be appreciated by those of skill in the art, the operating systems 452 may be any operating system suitable for use with a data processing system, such as OS/2, AIX, or zOS from International Business Machines Corporation, Armonk, NY, Windows CE, Windows NT, Windows95, Windows98, Windows2000, WindowsXP, Windows Visa, Windows7, Windows 8, Windows 8.1, Windows CE or other Windows versions from Microsoft Corporation, Redmond, WA, Palm OS, Symbian OS, Cisco IOS, VxWorks, Unix or Linux, Mac OS from Apple Computer, LabView, or proprietary operating systems.

The I/O device drivers 458 typically include software routines accessed through the operating system 449 by the application programs 454 to communicate with devices such as I/O data port(s), data storage 455 and certain memory 414 components. The application programs 454 are illustrative of the programs that implement the various features of the data processing system and can include at least one application, which supports operations according to embodiments of the present invention. Finally, the data 455 represents the static and dynamic data used by the application programs 454, the operating system 452, the I/O device drivers 458, and other software programs that may reside in the memory 414.

While the present invention is illustrated, for example, with reference to the Cryo-collection Module ("Module") 450 being an application program in FIG. 11, as will be appreciated by those of skill in the art, other configurations may also be utilized while still benefiting from the teachings of the present invention. For example, the Module may also be incorporated into the operating system 452, the I/O device drivers 458 or other such logical division of the data processing system. Thus, the present invention should not be construed as limited to the configuration of FIG. 11 which is intended to encompass any configuration capable of carrying out the operations described herein. Further, Module 450 can communicate with or be incorporated totally or partially in other components, such as a separate controller for the cryo-collection system 30 or be incorporated into a single controller and/or processor for the hyperpolarizer 10.

The I/O data port can be used to transfer information between the data processing system and another computer system or a network (e.g., the Internet) or to other devices controlled by the processor. These components may be conventional components such as those used in many conventional data processing systems, which may be configured in accordance with the present invention to operate as described herein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A cryo-collection system comprising:

an accumulator having a gas flow path configured for receiving and condensing a target gas from a gas mixture;

a dewar that encloses at least part of the accumulator providing the gas flow path, wherein the dewar comprises a chamber that is configured to hold liquid that is in thermal communication with the accumulator and that is in fluid isolation from the gas flow path, wherein the dewar comprises a liquid drain port in fluid communication with the chamber;

a coolant liquid source configured to supply a coolant liquid to the chamber, wherein the coolant liquid freezes the target gas from the gas mixture to thereby collect the target gas in the gas flow path of the accumulator; and a heated liquid source configured to supply heated liquid to the chamber, wherein the heated liquid has a temperature sufficient to thaw frozen target gas, wherein the system is configured so that the coolant liquid and the heated liquid both serially drain from the chamber through the drain port.

2. The system of claim 1, further comprising a drain path comprising a first drain valve downstream of the drain port of the chamber.

3. The system of claim 2, wherein the drain path further comprises a second drain valve downstream of the drain port, and wherein the second drain valve is spaced apart from the first drain valve.

4. The system of claim 3, further comprising a controller in communication with the first drain valve and the second drain valve and configured to controllably open and close the first and second drain valves so that only the first drain valve is open when the coolant liquid is drained from the chamber and only the second drain valve is open when the heated liquid is drained from the chamber.

5. The system of claim 1, wherein the chamber is configured to hold a volume of liquid in a range of 0.5 liters to 2 liters.

6. The system of claim 2, further comprising an outlet heater in the drain path upstream of the first drain valve, between the first drain valve and the drain port.

7. The system of claim 3, further comprising an outlet heater in the drain path, upstream of the second drain valve, between the second drain valve and the drain port.

8. The system of claim 1, wherein the drain port resides at a bottom portion of the dewar.

9. The system of claim 1, wherein the coolant liquid source comprises liquid nitrogen.

10. The system of claim 1, wherein the heated liquid source comprises a tank of heated water.

11. The system of claim 6, wherein the outlet heater is coupled to an external surface of a metal tube extending through a bottom portion of the dewar below the drain port and the metal tube is configured to provide part of the drain path.

12. The system of claim 1, further comprising a drain path comprising a metal tube extending outward from a bottom portion of the dewar in fluid communication with the drain port.

13. The system of claim 12, wherein a first drain valve is coupled to a first external end of the metal tube and a second drain valve is coupled to a second external end of the metal tube, and wherein the first external end of the metal tube is diametrically opposed to the second external end of the metal tube about a body of the dewar.

14. The system of claim 1, wherein the dewar comprises at least one fill port in fluid communication with the coolant liquid source and/or the heated liquid source.

15. The system of claim 1, wherein the dewar comprises a first fill port in fluid communication with the coolant liquid source and a second fill port in fluid communication with the heated liquid source.

16. The system of claim 1, wherein the target gas is hyperpolarized $^{129}$Xe, wherein the accumulator comprises an entry conduit in communication with a valve and is configured to receive the hyperpolarized $^{129}$Xe, and an exit conduit that flowably transfers thawed hyperpolarized $^{129}$Xe out to a collection vessel after thaw.

17. The system of claim 1, wherein the gas flow path of the accumulator comprises a tube segment provided in a curvilinear shape.

18. The system of claim 1, further comprising:

first and second drain valves that are spaced apart and coupled to a drain path, wherein the drain path is in fluid communication with the drain port;

first and second outlet heaters coupled to the drain path;

a temperature probe in the chamber; and a controller configured to:

direct a valve of the coolant liquid source to open to flow the coolant liquid to the chamber;

then close the valve to stop the flow of coolant liquid into the chamber;

monitor temperature in the chamber using the temperature probe and open the valve to flow additional coolant liquid into the chamber if the temperature in the chamber rises above a defined temperature;

then when collection is complete, direct the first drain valve to open while the second drain valve remains closed to drain the coolant liquid from the drain port;

then close the first drain valve; and then direct the heated liquid source to flow the heated liquid to the chamber while the first drain valve and the second drain valve are closed.

19. The system of claim 1, wherein, in operation, liquid is held in the chamber to a fill level whereby a sub-segment of the accumulator is surrounded by the liquid, wherein the dewar comprises a drain path below the drain port, and wherein liquid is held in the drain path when the liquid is in a fill level in the chamber during freeze and thaw actions provided by the coolant liquid and the heated liquid, respectively.

20. A flow-through spin exchange optical pumping (SEOP) hyperpolarized gas production system for producing hyperpolarized gas comprising:

a pressurized gas mixture providing the gas mixture with the target gas, wherein the gas mixture is a noble gas mixture and the target gas is $^{129}$Xe;

a flow-through optical pumping cell in fluid communication with the pressurized gas mixture configured to provide a hyperpolarized gas mixture; and the cryo-collection system of claim 1 downstream of and in fluid communication with the flow-through optical pumping cell.

21. The flow-through SEOP gas production system of claim 20, further comprising a flexible patient dose delivery bag downstream of the cryo-collection system and comprising an inhalable bolus of hyperpolarized $^{129}$Xe collected, then thawed by the cryo-collection system.

22. The flow-through SEOP gas production system of claim 20, wherein the cryo-collection system is provided as a first cryo-collection system, wherein the flow-through SEOP gas production system further comprises a second cryo-collection system downstream of and in fluid communication with the optical pumping cell, wherein the second cryo-collection system comprises a second dewar with the chamber and drain port, wherein the first and second cryo-collection systems are serially and alternately operable to collect frozen $^{129}$Xe from the hyperpolarized gas mixture from the optical pumping cell.

23. A method of collecting hyperpolarized $^{129}$Xe, comprising:

providing a cryo-collection system comprising a dewar with an internal liquid chamber and an accumulator;

flowing liquid nitrogen into the chamber to cool the accumulator to a sufficient temperature to freeze and collect hyperpolarized $^{129}$Xe from a hyperpolarized noble gas mixture;

then draining the liquid nitrogen from the chamber; then flowing heated water into the chamber to heat the collected hyperpolarized $^{129}$Xe to a sufficient temperature to thaw the collected hyperpolarized $^{129}$Xe; and then flowing the thawed hyperpolarized $^{129}$Xe out of the accumulator into an enclosed flow path.

24. A dewar for cryo-collection, comprising:

a dewar body enclosing a chamber; and a drain port in the dewar body in fluid communication with the chamber.

25. The method of claim 23, further comprising, after the flowing out of the accumulator, filling a container with at least one bolus amount of hyperpolarized $^{129}$Xe gas.

26. The method of claim 25, further comprising dispensing a bolus of the at least one bolus amount of hyperpolarized $^{129}$Xe gas from the container to a patient for inhalation to thereby allow for gas exchange and/or ventilation evaluation of a lung or lungs of the patient.

27. The method of claim 23, further comprising draining the water from the chamber, then flowing another quantity of liquid nitrogen into the chamber to cool the accumulator to freeze and collect another amount of hyperpolarized $^{129}$Xe from a hyperpolarized noble gas mixture.

28. The method of claim 27, wherein the draining the liquid nitrogen and the draining the water are both carried out using a common drain located at a bottom of the dewar.

29. The method of claim 23, wherein the providing the cryo-collection system comprises providing first and second cryo-collection systems, each comprising a respective dewar with internal liquid chamber, accumulator, and liquid nitrogen and water flow paths, the method further comprises directing either the first or the second cryo-collection system to collect hyperpolarized $^{129}$Xe from the hyperpolarized noble gas mixture to thereby alternate between the use of the first and second cryo-collection systems to reduce or eliminate deadtime between successive collections of hyperpolarized $^{129}$Xe from the hyperpolarized noble gas mixture.

30. The dewar of claim 24, further comprising at least one liquid fill port in fluid communication with the chamber.

31. The dewar of claim 24, further comprising a drain path comprising a metal tube extending outward from a bottom portion of the dewar in fluid communication with the drain port.

32. The dewar of claim 31, wherein a first drain valve is coupled to a first external end of the metal tube and a second drain valve is coupled to a second external end of the metal tube, and wherein the first external end of the metal tube is diametrically opposed to the second external end of the metal tube about a body of the dewar.

33. The dewar of claim 24, further comprising an outlet heater coupled to an external surface of a metal tube extending through a bottom portion of the dewar below the drain port, wherein the metal tube provides part of drain path.

* * * * *